US010818134B2

(12) United States Patent
Benartzi et al.

(10) Patent No.: US 10,818,134 B2
(45) Date of Patent: Oct. 27, 2020

(54) SYSTEMS AND METHODS FOR PROVIDING CUSTOMIZED FINANCIAL ADVICE USING LOSS AVERSION ASSESSMENTS

(71) Applicant: Digital Nudging Tech LLC, Las Vegas, NV (US)

(72) Inventors: Shlomo Benartzi, Santa Monica, CA (US); John W. Payne, Chapel Hill, NC (US)

(73) Assignee: Digital Nudging Tech LLC, Las Vegas, NV (US)

( * ) Notice: Subject to any disclaimer, the term of this patent is extended or adjusted under 35 U.S.C. 154(b) by 0 days.

(21) Appl. No.: 16/422,270

(22) Filed: May 24, 2019

(65) Prior Publication Data

US 2019/0279462 A1 Sep. 12, 2019

Related U.S. Application Data

(63) Continuation of application No. 15/354,608, filed on Nov. 17, 2016, now abandoned.

(51) Int. Cl.
*G07F 17/32* (2006.01)

(52) U.S. Cl.
CPC ..... *G07F 17/3239* (2013.01); *G07F 17/326* (2013.01); *G07F 17/3237* (2013.01); *G07F 17/3244* (2013.01)

(58) Field of Classification Search
None
See application file for complete search history.

(56) References Cited

U.S. PATENT DOCUMENTS

| | | | | |
|---|---|---|---|---|
| 7,050,998 | B1 | 5/2006 | Kale | |
| 2003/0036989 | A1 | 2/2003 | Bhatia | |
| 2003/0233301 | A1 | 12/2003 | Chen | |
| 2016/0284169 | A1* | 9/2016 | Racho | G07F 17/3244 |
| 2017/0124652 | A1* | 5/2017 | Beaven | G06Q 40/06 |
| 2017/0132706 | A1* | 5/2017 | Kariv | G06Q 40/025 |

OTHER PUBLICATIONS

"Myopic Loss Aversion and the Equity Premium Puzzle" by Shlomo Benartzi and Richard H. Thaler, published in The Quarterly Journal of Economics, vol. 110, No. 1, (Feb. 1995), pp. 73.92.

* cited by examiner

*Primary Examiner* — James S. McClellan
*Assistant Examiner* — Peter J Iannuzzi
(74) *Attorney, Agent, or Firm* — LeonardMeyer LLP

(57) ABSTRACT

A system, method, and non-transitory computer readable medium having instructions for determining a loss aversion score for a user. A gamble table comprises a plurality of gamble pairs. Each gamble pair includes a loss aversion gamble and a gain seeking gamble. A loss aversion coefficient for each gamble pair is determined. The gamble pairs are displayed in random order and user selections are received. The user selections include, for each gamble pair, one of the loss aversion gamble and the gain seeking gamble. The gamble pairs are arranged in an ascending order or a descending order based on the loss aversion coefficients and a transition among the user selections is identified. The transition is used to determine the loss aversion score. The loss aversion score depends at least in part on the loss aversion coefficient of the gamble pair associated with the identified transition.

18 Claims, 14 Drawing Sheets

SYSTEMS AND METHODS FOR PROVIDING CUSTOMIZED FINANCIAL ADVICE USING LOSS AVERSION ASSESSMENTS

CROSS-REFERENCES TO RELATED APPLICATIONS

This application is a continuation of U.S. patent application Ser. No. 15/354,608 titled "Systems and Methods for Providing Customized Financial Advice Using Loss Aversion Assessments", filed Nov. 17, 2016, which claims priority to U.S. Provisional Patent Application, Ser. No. 62/261,721 titled "Customizing Financial Advice Using Loss Aversion Assessments", filed Dec. 1, 2015, the disclosure of which is incorporated by reference herein in its entirety.

FIELD OF THE INVENTION

The disclosure relates generally to the field of customized financial advice. More specifically, the disclosure relates to quantifying a user's aversion to losses so as to provide the user financial advice consistent with the user's loss aversion.

SUMMARY

Systems, methods, and non-transitory computer readable mediums for determining a loss aversion score for a user to quantify the user's tolerance for risk are disclosed herein.

According to an embodiment, a computer-implemented method for determining a loss aversion score for a user is provided. The loss aversion score quantifies the user's tolerance for risk to allow for the generation of personalized financial advice. The method includes the step of generating a gamble table comprising a plurality of gamble pairs. Each of the plurality of gamble pairs include a loss aversion gamble and a gain seeking gamble. The method includes the step of determining a loss aversion coefficient for each of the plurality of gamble pairs, and the step of displaying each of the plurality of gamble pairs in a random order. The method comprises the step of receiving a user selection for each of the plurality of gamble pairs. Each user selection includes one of the loss aversion gamble and the gain seeking gamble. The method includes the step of arranging the plurality of gamble pairs in at least one of an ascending order and a descending order based on the loss aversion coefficients, and the step of identifying at least one transition among the user selections. The method further includes the step of using the at least one transition to determine the loss aversion score, and the step of displaying a message based on the loss aversion score. The loss aversion score depends at least in part on the loss aversion coefficient of a gamble pair associated with the transition.

Embodiments of the computer-implemented method for determining a loss aversion score may include one or more of the following, in any combination.

In an embodiment of the computer-implemented method, each loss aversion gamble includes a first amount, a second amount, and a third amount. The first amount is greater than the second amount and the second amount is greater than the third amount. The gain seeking gamble includes a fourth amount, a fifth amount, and a sixth amount. The fourth amount is greater than the fifth amount and the fifth amount is greater than the sixth amount. The fourth amount is greater than the first amount and the sixth amount is less than the third amount.

An embodiment of the computer-implemented method includes the step of using the at least one transition to determine at least one of a loss aversion upper bound and a loss aversion lower bound.

An embodiment of the computer-implemented method includes the step of averaging the loss aversion upper bound and the loss aversion lower bound to determine the loss aversion score.

An embodiment of the computer-implemented method includes the step of determining that the at least one transition equals two or more transitions, and the step of displaying a message informing the user that the user selections include an inconsistency.

In an embodiment of the computer-implemented method, each of the first amount, second amount, and third amount have an equal probability of occurrence.

In an embodiment of the computer-implemented method, the loss aversion coefficient for each gamble pair is determined using the formula:

$$(\text{fourth amount}-\text{first amount})/|(\text{third amount}-\text{sixth amount})|.$$

In another embodiment, a personalized loss aversion determination system is provided. The loss aversion determination system includes a plurality of first data storage devices and a loss aversion computing device. The plurality of first data storage devices maintain a gamble table, where the gamble table includes N gamble pairs, with N being greater than or equal to two. Each gamble pair includes a loss aversion gamble, a gain seeking gamble, and a corresponding loss aversion coefficient. The loss aversion computing device is in communication with the first plurality of data storage devices and is operative to perform the following, for each gamble pair from i=1 to N: transmit, in response to a user request, an $i^{th}$ gamble pair for display by a user computing device, the $i^{th}$ gamble pair including an $i^{th}$ loss aversion gamble and a $i^{th}$ gain seeking gamble; receive, in response to transmitting the $i^{th}$ gamble pair, a selection of either the $i^{th}$ loss aversion gamble or the $i^{th}$ gain seeking gamble; identify, from the received selections, transitions between selections representing a change of user attitude between loss aversion and gain seeking; and calculate a personalized loss aversion score for the user based upon the loss aversion coefficients corresponding to the identified transitions.

Embodiments of the personalized loss aversion determination system may further include one or more of the following, in any combination.

In an embodiment of the loss aversion determination system, the $i^{th}$ gain seeking gamble includes a first outcome, $a_i$, having a first probability, $p_i$; a second outcome, $b_i$, having a second probability, $q_i$; and a third outcome, $c_i$, having a third probability, $1-p_i-q_i$; where $a_i>b_i>c_i$. The $i^{th}$ loss aversion gamble includes a fourth outcome, $x_i$, having a fourth probability, $r_i$; a fifth outcome, $y_i$, having a fifth probability, $s_i$; and a sixth outcome, $z_i$, having a sixth probability, $1-r_i-s_i$; where $x_i>y_i>z_i$; and where $a_i>x_i$, $b_i=y_i$, and $c_i<z_i$.

In an embodiment of the system, the loss aversion computing device is further operative to identify the transitions by: examining the selections in ascending order of loss coefficient until a first transition between loss averse and gain seeking selections is detected; determining a loss aversion lower bound (LALB) as the loss aversion coefficient corresponding to the gamble pair ascendingly examined immediately prior to the first transition; examining the selections in descending order of loss coefficient until a second transition between loss averse and gain seeking selections is detected; and determining a loss aversion upper bound (LAUB) as the loss coefficient corresponding to the gamble pair descendingly examined immediately prior to the second transition.

In an embodiment of loss aversion determination system, the loss aversion computing device is further operative to calculate the personalized loss aversion score as the average of the LALB and the LAUB.

In an embodiment of the loss aversion determination system, the first probability, second probability, and the third probability are equal.

In an embodiment of the loss aversion determination system, at least one of the first probability and the second probability is different from the third probability.

According to yet another embodiment, a non-transitory computer readable medium with computer executable instructions stored thereon executed by a digital processor to perform the method of determining a loss aversion score for a user comprises instructions for generating a gamble table comprising a plurality of gamble pairs. Each of the plurality of gamble pairs includes a loss aversion gamble and a gain seeking gamble. The medium includes instructions for determining a loss aversion coefficient for each of the plurality of gamble pairs, and instructions for displaying each of the plurality of gamble pairs in a random order. The medium includes instructions for receiving, for each of the plurality of gamble pairs, a user selection. Each user selection includes one of the loss aversion gamble and the gain seeking gamble. The medium also includes instructions for identifying at least one transition among the user selections based on the loss aversion coefficients and for determining the loss aversion score based on the loss aversion coefficient associated with the at least one identified transition. The medium further includes instructions for displaying a message based on the loss aversion score.

Embodiments of the non-transitory computer readable medium may include one or more of the following, in any combination.

In an embodiment, the non-transitory computer readable medium includes instructions for generating the gamble table such that no gain seeking gamble in one gamble pair is the same as a gain seeking gamble in another gamble pair.

In an embodiment, the non-transitory computer readable medium includes instructions for using the at least one transition to determine at least one of a loss aversion upper bound and a loss aversion lower bound.

In an embodiment, the non-transitory computer readable medium includes instructions for averaging the loss aversion upper bound and the loss aversion lower bound to determine the loss aversion score.

In an embodiment, the non-transitory computer readable medium includes instructions for determining that the at least one transition equals a plurality of transitions.

In an embodiment, the non-transitory computer readable medium includes instructions for determining that the plurality of transitions indicate an inconsistency in the user selections.

In an embodiment, the computer executable instructions on the non-transitory computer readable medium are accessible, at least in part, over a mobile computer.

BRIEF DESCRIPTION OF THE DRAWINGS

The foregoing aspects and many of the attendant advantages of the disclosed embodiments will become more readily appreciated by reference to the following detailed description, when taken in conjunction with the accompanying drawings, wherein.

DETAILED DESCRIPTION

An ongoing area of interest in the financial advising industry is how to better customize financial advice. One approach is measuring how individuals feel about losses (e.g., monetary losses), as losses are a significant component in perceiving and defining "risk." Research has also shown that sensitivity to losses plays an important role in determining an individual's decisions under risk. Unfortunately, existing mechanisms for gauging individuals risk tolerance (e.g., questionnaires) are generally qualitative and not scientifically-based. Accordingly, there is an ongoing need for improved approaches to customizing financial advice.

Loss aversion may be an accurate predictor of financial choices including the timing of social security benefit claims, preferences for annuities, and investment choices. Accordingly, embodiments of the present disclosure are directed to quantitative measurement of loss aversion and incorporation of such loss aversion measurements into financial advising. For example, as discussed in greater detail below, loss aversion measurements are mapped to investment portfolios and fund ratings, providing recommendations that are better suited to an individual's unique aversion to loss, rather than recommendations based upon the behavior of the "average person."

Figure 1:
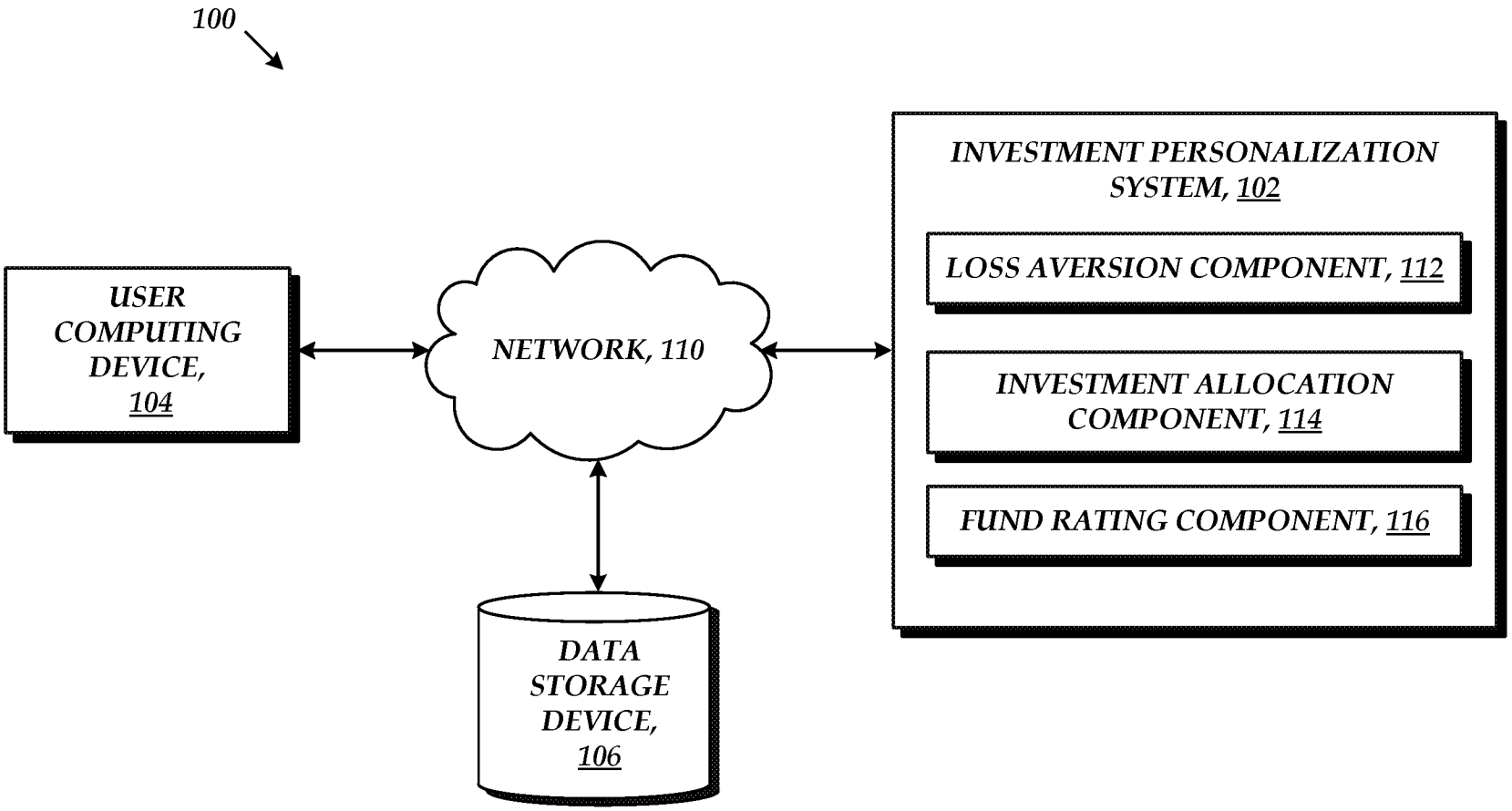
FIG. 1 is a block diagram illustrative of an embodiment of a computing environment for measuring loss avoidance and providing customized financial advising based upon the measured loss avoidance.

The discussion will now turn to FIG. 1, which is a block diagram illustrating an embodiment of a computing environment 100 for measuring loss avoidance and providing customized financial advising based upon the measured loss avoidance. The computing environment 100 includes an investment personalization system 102, a user computing device 104, and a data storage device 106, each in communication via a network 110.

Embodiments of the investment personalization system 102 and the user computing device 104 may be independently selected by any computing device such as desktop computers, laptop computers, mobile phones, tablet computers, set top boxes, entertainment consoles, server computers, client computers, and the like. Embodiments of the data storage device 106 may include one or more data storage devices capable of maintaining computer-readable data. Examples may include, but are not limited to, magnetic storage (e.g., tape, hard disk drives, etc.), solid state storage (e.g., flash memory, etc.), network storage, and other computer-readable media known in the art. Embodiments of the network 110 may include, but are not limited to, local area networks (LANs), wide area networks (WAN), the Internet, wired networks, wireless networks), and telephone networks.

The investment personalization system 102 includes a loss aversion component 112, an investment allocation component 114, and a fund rating component 116. While the investment personalization system 102 is illustrated in FIG. 1 as a single device, it may be understood that functionalities of one or more of the loss aversion component 112, the investment allocation component 114, and/or the fund rating component 116 may be performed by a distributed computing environment including a plurality of computing devices, without limit.

Loss Aversion Component

The loss aversion component 112 of the investment personalization system 102 determines a loss aversion score (LAS) for a user. As discussed in greater detail below with respect to FIGS. 2A-2D and 3A-3D, the user is presented with pairs of hypothetical gambles and asked to pick one of the two gambles. Each gamble pair presents a different amount of money that can be potentially lost or potentially gained in the gamble. The user's selections from a number of gamble pairs provide a pattern that may be quantified into a measure of the user's aversion to loss.

Figure 2A:
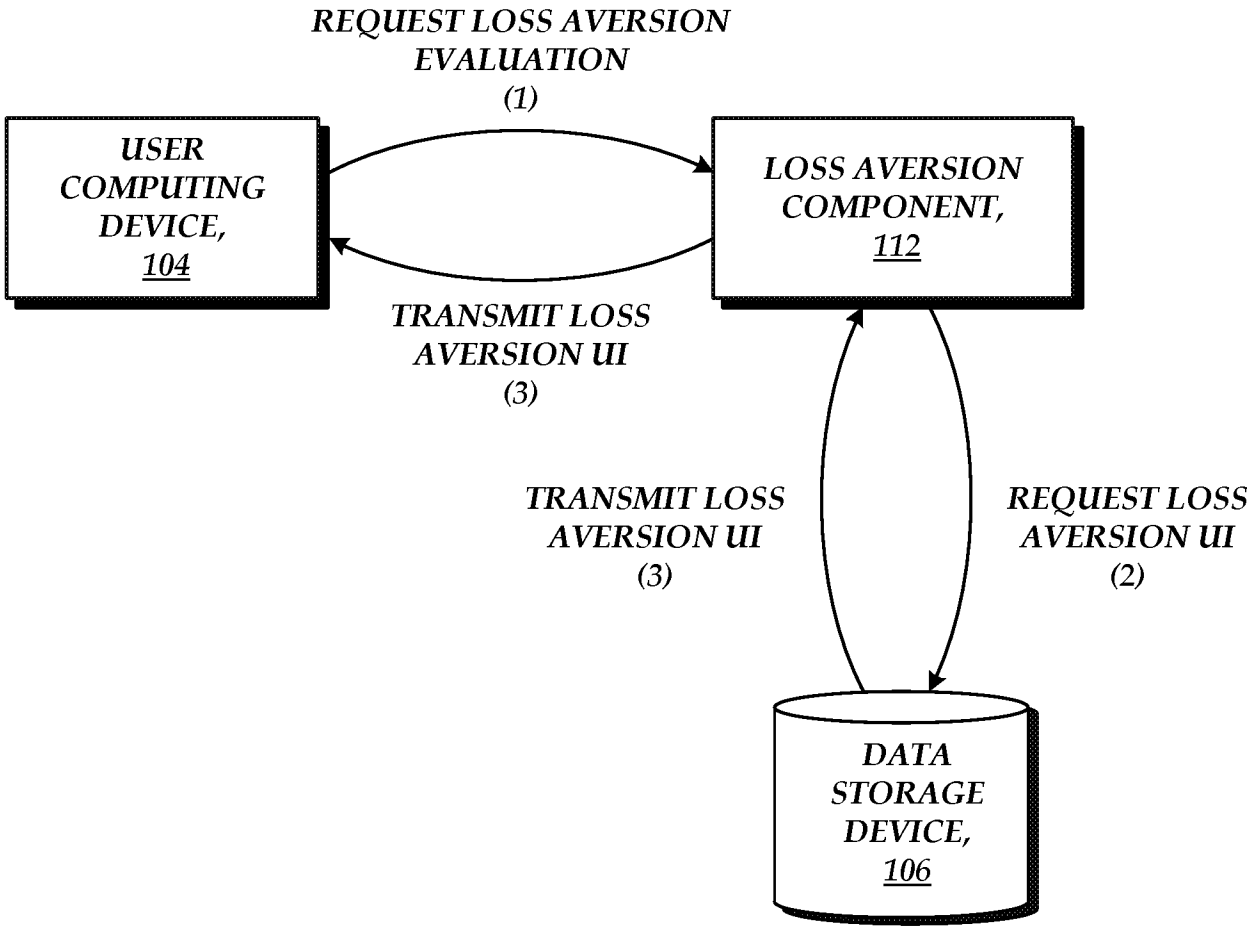
FIGS. 2A-2D are block diagrams illustrating information flow within the computing environment between an investment personalization system and a user computing device for calculating a personalized loss aversion score for the user.

With reference to FIG. 2A, the loss aversion component 112 receives a request from the user computing device 104 to perform a loss aversion evaluation. In response, the loss aversion component 112 obtains loss aversion user interfaces (e.g., from data storage device 106) and transmits the loss aversion user interfaces to the user computing device 104 for display. Such user interfaces may include a welcome screen 300 (FIG. 3A), terms and conditions 302 (FIG. 3B), instructions 304 (FIG. 3C), demographic queries 306 (FIG. 3D), gamble pairs for selection 310 (FIG. 3E), and the user's calculated loss aversion score 312 (FIG. 3F).

Figure 2B:
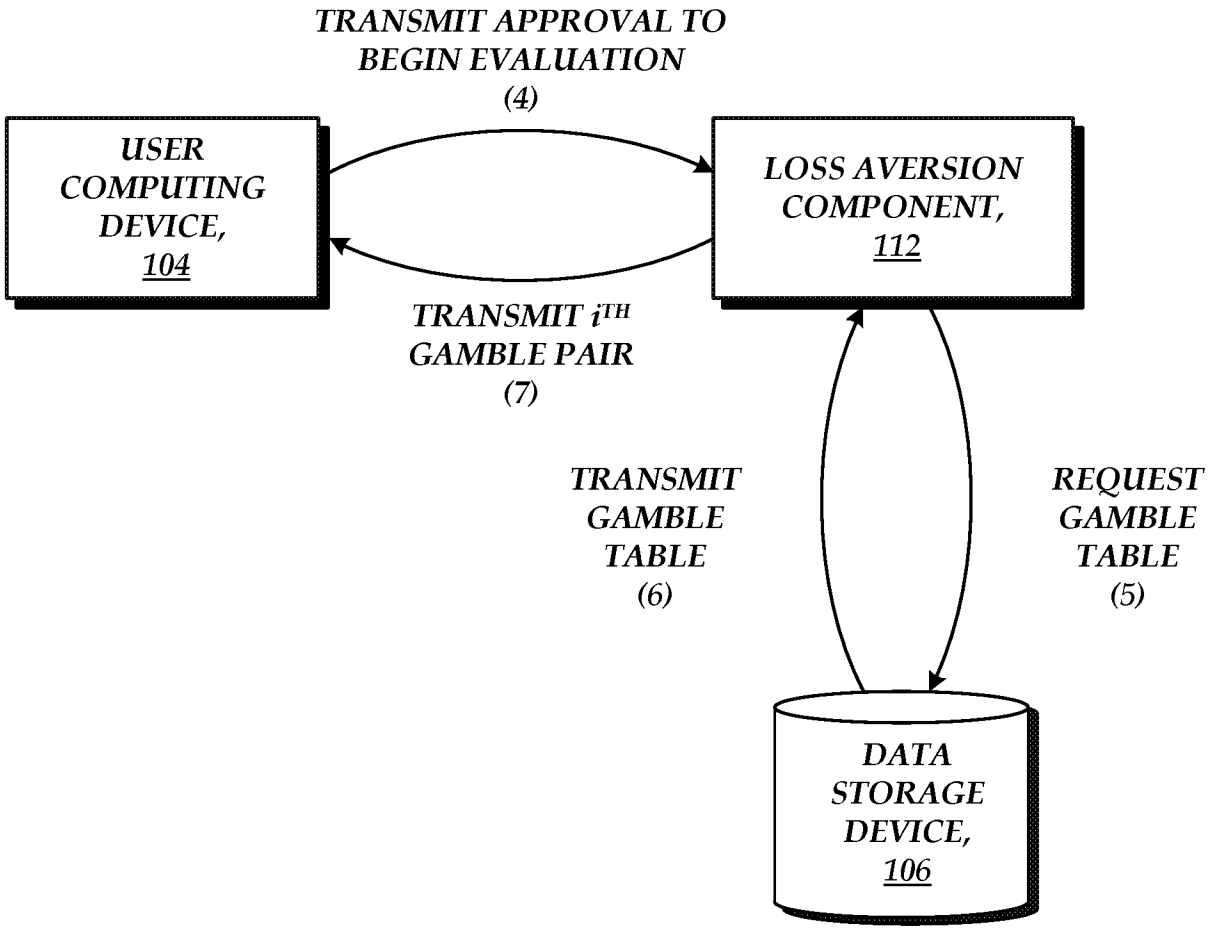
Figure 3A:
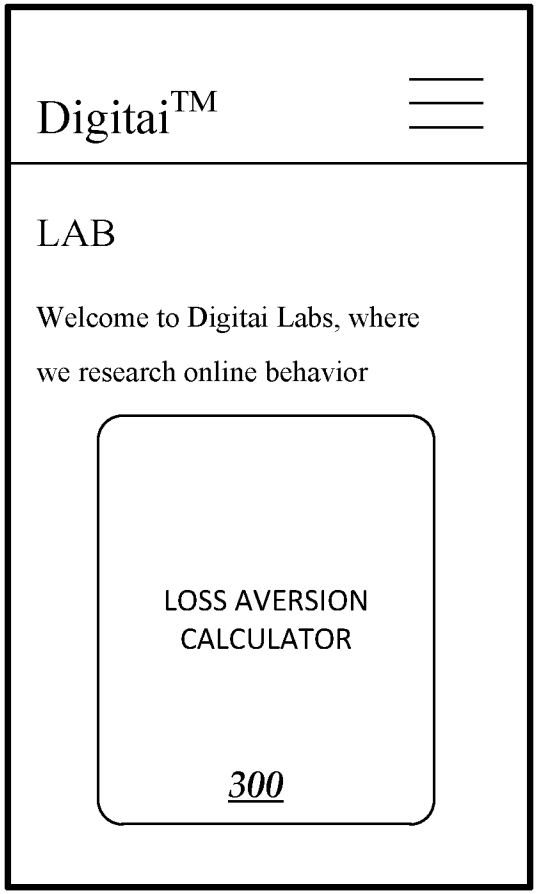
FIGS. 3A-3F are schematic illustrations of embodiments of user interfaces provided by the investment personalization system for display by the user computing device.
Figure 3B:
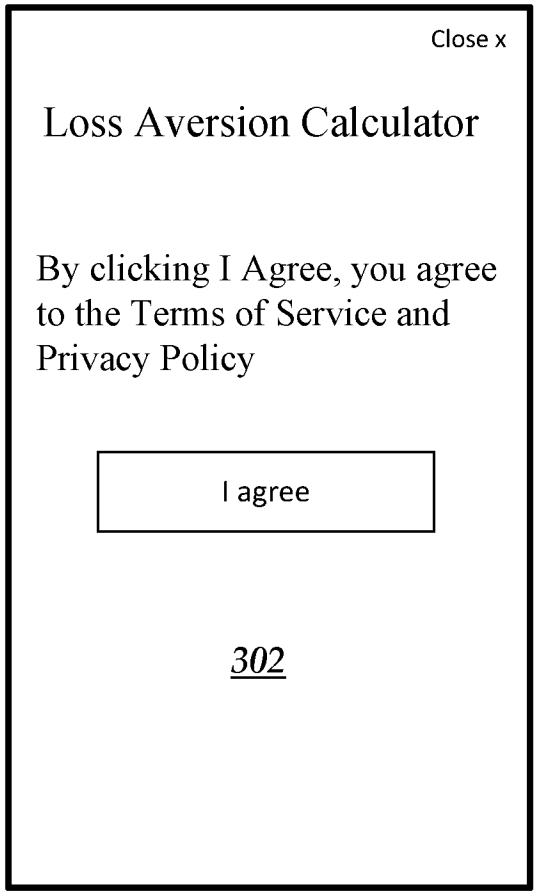
Figure 3C:
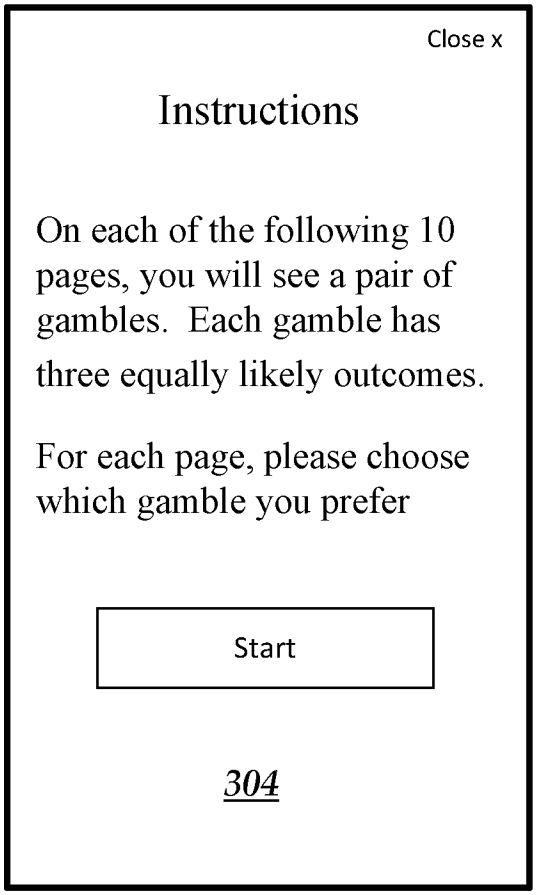
Figure 3D:
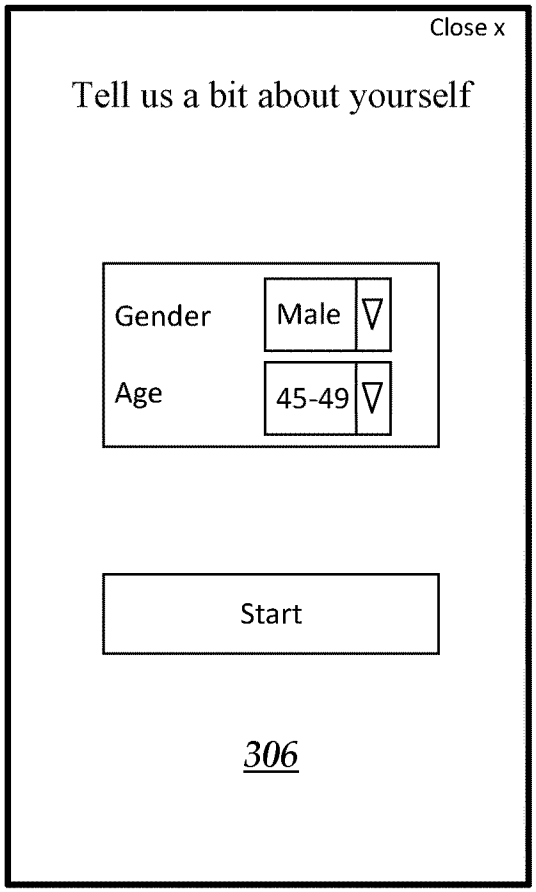
Figure 3E:
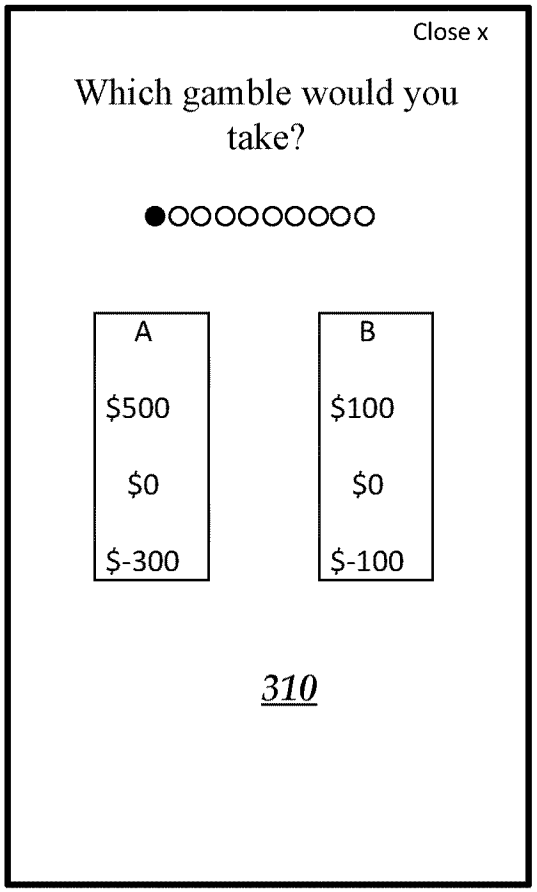
Figure 3F:
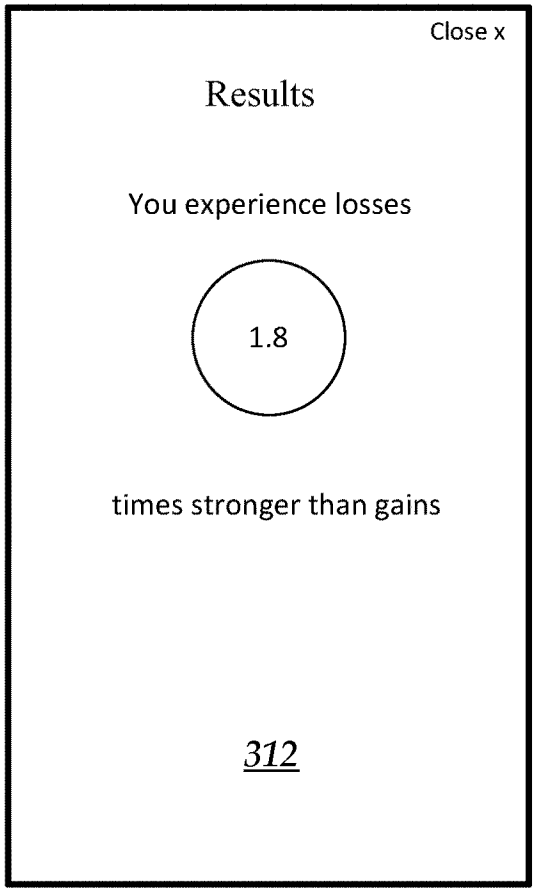

With further reference to FIG. 2B, the loss aversion component 112 receives gamble pairs and transmits the gamble pairs to the user computing device 104 for selection. A first gamble of the gamble pair has the form:

a
b
c where a>b>c and the probability of each outcome is equal. An example of the first gamble is:

$500
$0
−$300 as illustrated in Gamble A of user interface 310 (FIG. 3E). The second gamble of the gamble pair has the form:

x
y
z where x>y>z, the probability of each outcome is equal and a>x, b=y, and c<z. An example of the second gamble is:

$100
$0
$100 as illustrated in Gamble B of user interface 310 (FIG. 3E).

It may be observed that the first gamble provides the possibility of a greater return as compared to the second gamble (i.e., $500 vs. $100). However, the first gamble also provides the possibility of a greater loss as compared to the second gamble (i.e., −$300 vs. −$100). Accordingly, the first gamble is considered a "gain seeking" gamble since selection of this gamble reflects a greater tolerance for loss (lower loss avoidance) as compared to the second gamble. Likewise, the second gamble is considered a "loss averse" gamble, since selection of this gamble reflects a lower tolerance for loss (greater loss avoidance) as compared to the first gamble.

In further embodiments, the probabilities for respective outcomes within a gamble may differ. For example, instead of each outcome having an equal probability (33⅓%; 33½%, 33⅓%), the probabilities may be other combinations of probabilities summing to 100% (e.g., 45%; 10%; 45%).

In additional embodiments, the values of each outcome may differ. For example, the respective values of each wager may adopt any value, provided that the gamble pair provides a risk averse gamble and a gain seeking gamble.

Each gamble pair is further associated with a loss aversion coefficient. The loss aversion coefficient quantifies the relative degree of loss aversion represented by the gamble pair. In an embodiment, the loss aversion coefficient is given by the ratio of two quantities. The numerator of the ratio is the absolute value of the difference between the possible winnings for the loss averse gamble and gain seeking gamble. The denominator of the ratio is the absolute value of the difference between the possible losses for the loss averse gamble and the gain seeking gamble. For example, using the example of gain seeking Gamble A and loss averse Gamble B, the loss aversion coefficient is 2.0 (i.e., (|$500−$100|)/($|−100−(−$300)|)).

For the examples below, assume that 10 gamble pairs are to be presented to the user. The set of gamble pairs and corresponding loss aversion coefficient will be referred to herein as a gamble table.

TABLE 1

Gamble Table

| Gamble | Loss Averse (LA) | | | Gain Seeking (GS) | | | Loss Aversion |
|---|---|---|---|---|---|---|---|
| Pair | X | Y | Z | a | b | c | Coefficient |
| 1 | $100 | $0 | −$100 | $ 200 | $0 | −$300 | 0.5 |
| 2 | $100 | $0 | −$100 | $ 300 | $0 | −$300 | 1.0 |
| 3 | $100 | $0 | −$100 | $ 350 | $0 | −$300 | 1.25 |
| 4 | $100 | $0 | −$100 | $ 400 | $0 | −$300 | 1.5 |
| 5 | $100 | $0 | −$100 | $ 500 | $0 | −$300 | 2.0 |
| 6 | $100 | $0 | −$100 | $ 600 | $0 | −$300 | 2.5 |
| 7 | $100 | $0 | −$100 | $ 700 | $0 | −$300 | 3.00 |
| 8 | $100 | $0 | −$100 | $ 900 | $0 | −$300 | 4.00 |
| 9 | $100 | $0 | −$100 | $1100 | $0 | −$300 | 5.00 |
| 10 | $100 | $0 | −$100 | $2100 | $0 | −$300 | 10.00 |

It may be understood that greater or fewer numbers of gamble pairs may be used in the gamble table and the gamble pairs may adopt any values consistent with the forms discussed above, without limit. In further embodiments, the gamble table includes at least two gamble pairs. Furthermore, while all gamble pairs in the gamble table are presented to the user without repetition in the examples below, embodiments of the investment personalization system may allow an operator to choose which gamble pairs of the gamble table are presented to the user.

Figure 2C:
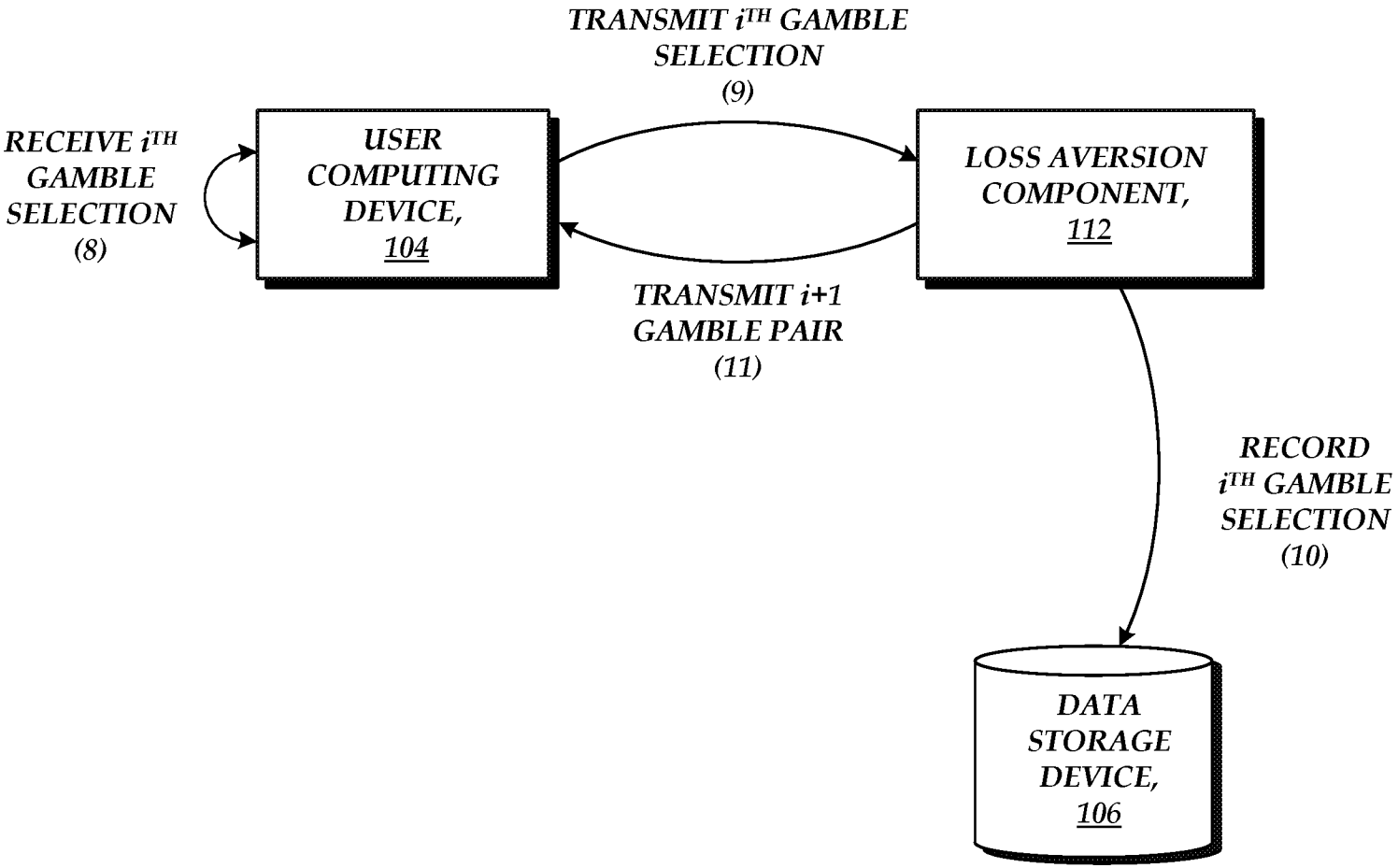

With further reference to FIG. 2C, in response to a user request for a loss aversion evaluation, the loss aversion component 112 chooses a gamble pair randomly from the gamble table. Subsequently, the loss aversion component 112 transmits the chosen gamble pair to the user computing device 104, where it is displayed to the user. The user selects either the loss averse gamble or the gain seeking gamble and the selection is returned to the loss aversion component 112. This process is repeated by the loss aversion component 112 until each gamble pair has been transmitted to the user computing device 104 and a corresponding user selection has been received by the loss aversion component 112 (or a time-out response period is exceeded). The user's gamble selections may be recorded (e.g., transmitted to data storage device 106 for storage or maintained in memory of the loss aversion component) for subsequent analysis by the loss aversion component 112.

Figure 2D:
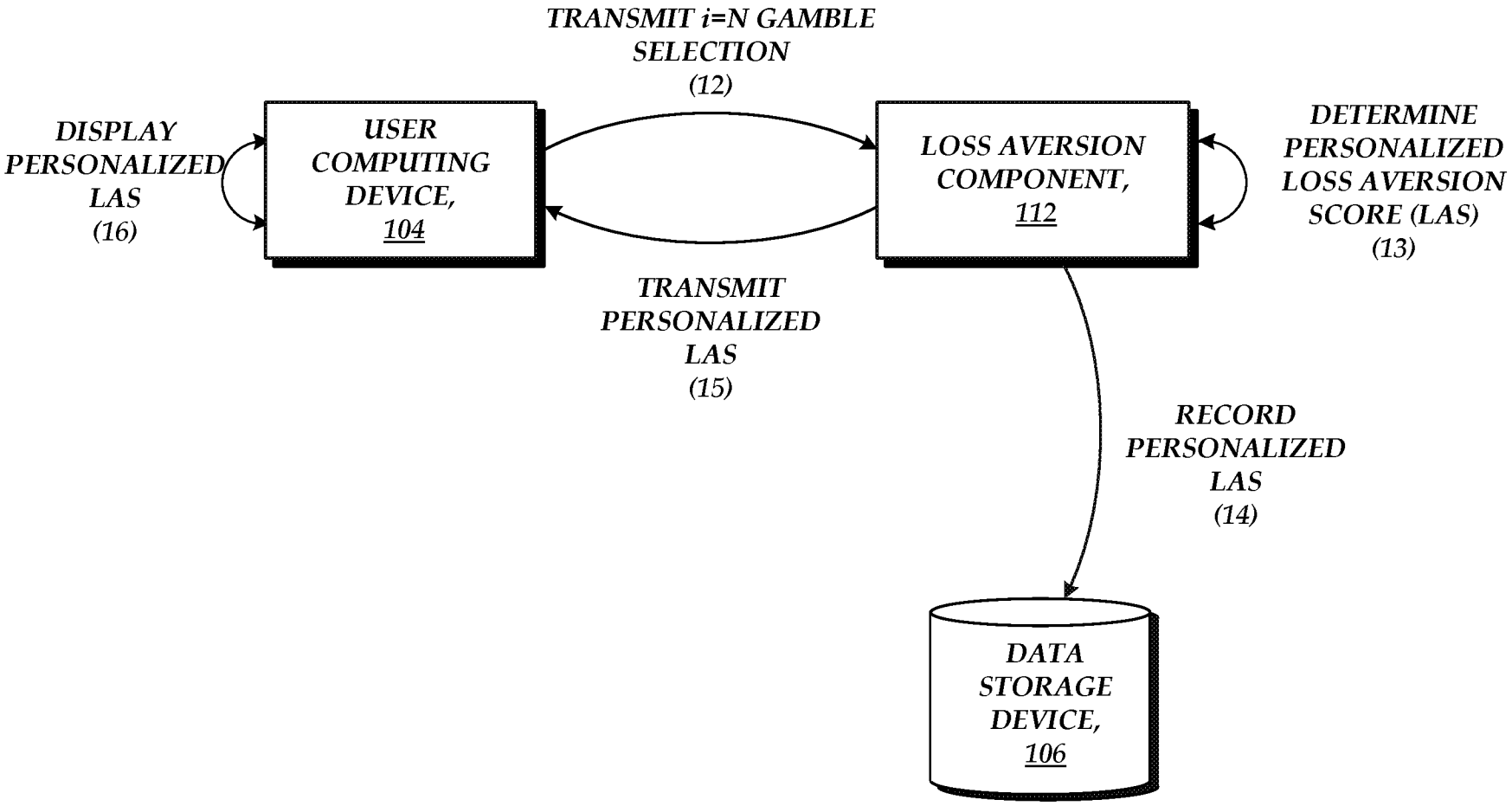

To calculate the user's loss aversion score, the user's selections are analyzed by the loss aversion component 112 (FIG. 2D). In an embodiment, the user's gamble pair selections are reviewed to identify a loss aversion lower bound (LALB) and a loss aversion upper bound (LAUB). The loss aversion component 112 reviews the user's gamble pair selections in ascending order of loss coefficient until a first transition between loss averse and gain seeking selections is identified. The LALB is determined to be the loss aversion coefficient of the gamble pair descendingly examined immediately prior to the transition. The loss aversion component 112 further reviews the user's gamble pair selections in descending order of loss coefficient until a second transition between loss averse and gain seeking selections is identified. The LAUB is determined to be the loss aversion coefficient of the gamble pair ascendingly examined immediately prior to the transition.

In an embodiment, the user's loss aversion score is calculated as an average of the LALB and LAUB. In an alternative embodiment, the loss aversion score is taken to be the LAUB. This reflects a conservative upper bound for measuring an individual's loss aversion score.

Subsequently, the calculated loss aversion score may be transmitted by the loss aversion component 112 to the user computing device 104 for display. Language accompanying the loss aversion score may also be provided, where the language is selected based upon the loss aversion score and whether the user's answers are consistent (only one transition) or inconsistent (greater than one transition). For example, the following language and ranges may be employed:

Consistent responses within the range 1≤LAS≤10
- "You experience losses [LAS] times stronger than gains."

Consistent responses within the range 0.5≤LAS≤1
- "You experience gains slightly stronger than losses."

Consistent responses within the range LAS≤0.5
- "You experience gains stronger than losses."

Consistent responses within the range LAS>10
- "You experience losses more than 10 times stronger than gains."

Inconsistent responses within the range LAS≤10
- "You experience losses [LAS] times stronger than gains."
- "The above is our best estimate of your sensitivity to losses, but be aware that your responses exhibited some inconsistencies. Feel free to retake the test."

Inconsistent responses within the range LAS>10
- "You experience losses [LAS] times stronger than gains."
- "The above is our best estimate of your sensitivity to losses, but be aware that your responses exhibited some inconsistencies. Feel free to retake the test."

In the circumstance where no transition is identified in either ascending or descending order (i.e., each user selection is loss averse or gain seeking), the loss aversion component 112 may assign a pre-selected loss aversion score to the user.

Examples illustrating calculation of the user's loss aversion score in response to different user selections are discussed below.

Example 1—Consistent Responses 1≤LAS≤10

In Example 1, it is assumed that the user responds in a consistent manner. User selections under these conditions are reflected in Table 2. In Table 2, it may be observed that the user selected the loss averse gamble in gamble pairs 1-3 and selected the gain seeking gamble in gamble pairs 4-10.

TABLE 2

User Responses for Example 1

| Gamble | Loss Averse (LA) | | | Gain Seeking (GS) | | | Loss Aversion |
|---|---|---|---|---|---|---|---|
| Pair | x | y | z | a | b | c | Coefficient |
| 1 | $100 | $0 | −$100 | $ 200 | $0 | −$300 | 0.5 |
| 2 | $100 | $0 | −$100 | $ 300 | $0 | −$300 | 1.0 |
| 3 | $100 | $0 | −$100 | $ 350 | $0 | −$300 | 1.25 |
| 4 | $100 | $0 | −$100 | $ 400 | $0 | −$300 | 1.5 |
| 5 | $100 | $0 | −$100 | $ 500 | $0 | −$300 | 2.0 |
| 6 | $100 | $0 | −$100 | $ 600 | $0 | −$300 | 2.5 |
| 7 | $100 | $0 | −$100 | $ 700 | $0 | −$300 | 3.00 |
| 8 | $100 | $0 | −$100 | $ 900 | $0 | −$300 | 4.00 |
| 9 | $100 | $0 | −$100 | $1100 | $0 | −$300 | 5.00 |
| 10 | $100 | $0 | −$100 | $2100 | $0 | −$300 | 10.00 |

To determine the LALB, the user's selections are examined in ascending order of loss aversion coefficient, from gamble pair 1 to 10, until the first transition between loss averse and gain seeking selections is identified. The LALB is taken to be the loss aversion coefficient corresponding to the gamble pair ascendingly examined immediately prior to the first transition. In this circumstance, the first transition occurs between gamble pairs 3 and 4. Thus, the LALB is taken to be 1.25, the loss aversion coefficient corresponding to gamble pair 3.

To determine the LAUB, the user's selections are examined in descending order, from gamble pair 10 to 1, until the second transition between loss averse and gain seeking selections is identified. The LAUB is taken to be the loss aversion coefficient corresponding to the gamble pair descendingly examined immediately prior to the second transition. In this circumstance, the second transition occurs between gamble pairs 3 and 4. Thus, the LAUB is taken to be 1.50, the loss aversion coefficient corresponding to gamble pair 4.

The user's loss aversion score (LAS) is calculated by the loss aversion component 112 as an average of the LALB and LAUB. In this circumstance, the user's loss aversion score is 1.38, the average of 1.5 and 1.25. As the calculated loss aversion score lies within the range between 1≤LAS≤10, the loss aversion component 112 may transmit the LAS to the user computing device 104 stating, "You experience losses 1.38 times stronger than gains."

Example 2—Consistent Responses 0.5<LAS≤1

In Example 2, it is assumed that the user responds in a consistent manner. User selections under these conditions are reflected in Table 3. In Table 3, it may be observed that the user selected the loss averse gamble in gamble pair 1 and selected the gain seeking gamble in gamble pairs 2-10.

TABLE 3

| User Responses for Example 2 | | | | | | | |
|---|---|---|---|---|---|---|---|
| Gamble | Loss Averse (LA) | | | Gain Seeking (GS) | | | Loss Aversion |
| Pair | x | y | z | a | b | c | Coefficient |
| 1 | $100 | $0 | −$100 | $ 200 | $0 | −$300 | 0.5 |
| 2 | $100 | $0 | −$100 | $ 300 | $0 | −$300 | 1.0 |
| 3 | $100 | $0 | −$100 | $ 350 | $0 | −$300 | 1.25 |
| 4 | $100 | $0 | −$100 | $ 400 | $0 | −$300 | 1.5 |
| 5 | $100 | $0 | −$100 | $ 500 | $0 | −$300 | 2.0 |
| 6 | $100 | $0 | −$100 | $ 600 | $0 | −$300 | 2.5 |
| 7 | $100 | $0 | −$100 | $ 700 | $0 | −$300 | 3.00 |
| 8 | $100 | $0 | −$100 | $ 900 | $0 | −$300 | 4.00 |
| 9 | $100 | $0 | −$100 | $1100 | $0 | −$300 | 5.00 |
| 10 | $100 | $0 | −$100 | $2100 | $0 | −$300 | 10.00 |

To determine the LALB, the user's selections are examined in ascending order, from gamble pair 1 to 10, until the first transition between loss averse and gain seeking selections is identified. The LALB is taken to be the loss aversion coefficient corresponding to the gamble pair ascendingly examined immediately prior to the first transition. In this circumstance, the first transition occurs between gamble pairs 1 and 2. Thus, the LALB is taken to be 0.5, the loss aversion coefficient corresponding to gamble pair 1.

To determine the LAUB, the user's selections are examined in descending order, from gamble pair 10 to 1, until the second transition between loss averse and gain seeking selections is identified. The LAUB is taken to be the loss aversion coefficient corresponding to the gamble pair descendingly examined immediately prior to the second transition. In this circumstance, the second transition occurs between gamble pairs 1 and 2. Thus, the LAUB is taken to be 1.0, the loss aversion coefficient corresponding to gamble pair 2.

The user's loss aversion score is calculated by the loss aversion component 112 as an average of the LALB and LAUB. In this circumstance, the user's loss aversion score is 0.75, the average of 0.5 and 1.0. As the calculated loss aversion score (LAS) lies within the range between $0.5<LAS\leq 1$, the loss aversion component 112 may transmit the LAS to the user computing device 104 stating, "You experience gains slightly stronger than losses."

Example 3—Consistent Responses LAS≤0.5

In Example 3, it is assumed that the user responds in a consistent manner. User selections under these conditions are reflected in Table 4. In Table 4, it may be observed that the user did not select the loss averse gamble in any gamble pair and selected the gain seeking gamble in each of gamble pairs 1-10.

TABLE 4

| User Responses for Example 3 | | | | | | | |
|---|---|---|---|---|---|---|---|
| Gamble | Loss Averse (LA) | | | Gain Seeking (GS) | | | Loss Aversion |
| Pair | x | y | z | a | b | c | Coefficient |
| 1 | $100 | $0 | −$100 | $200 | $0 | −$300 | 0.5 |
| 2 | $100 | $0 | −$100 | $300 | $0 | −$300 | 1.0 |
| 3 | $100 | $0 | −$100 | $350 | $0 | −$300 | 1.25 |
| 4 | $100 | $0 | −$100 | $400 | $0 | −$300 | 1.5 |
| 5 | $100 | $0 | −$100 | $500 | $0 | −$300 | 2.0 |
| 6 | $100 | $0 | −$100 | $600 | $0 | −$300 | 2.5 |
| 7 | $100 | $0 | −$100 | $700 | $0 | −$300 | 3.00 |

TABLE 4-continued

| User Responses for Example 3 | | | | | | | |
|---|---|---|---|---|---|---|---|
| Gamble | Loss Averse (LA) | | | Gain Seeking (GS) | | | Loss Aversion |
| Pair | x | y | z | a | b | c | Coefficient |
| 8 | $100 | $0 | −$100 | $ 900 | $0 | −$300 | 4.00 |
| 9 | $100 | $0 | −$100 | $1100 | $0 | −$300 | 5.00 |
| 10 | $100 | $0 | −$100 | $2100 | $0 | −$300 | 10.00 |

In this circumstance, since no transition occurs, the LALB and LAUB are each taken to be the loss aversion coefficient corresponding to gamble pair 1. Thus, the LAS is 0.5. In an embodiment, for loss aversion coefficients less than 0.5, the score may be excluded and the loss aversion component 112 may transmit the following to the user computing device 104, "You experience gains stronger than losses." In alternative embodiments, the loss aversion component 112 may transmit the LAS to the user computing device 104, stating, "You experience gains more than 2 times stronger than losses."

Example 4—Consistent Responses LAS>10

In Example 4, it is assumed that the user responds in a consistent manner. User selections under these conditions are reflected in Table 5. In Table 5, it may be observed that the user selected the loss averse gamble in each of gamble pairs 1-10 and did not select the gain seeking gamble in any gamble pair.

TABLE 5

| User Responses for Example 4 | | | | | | | |
|---|---|---|---|---|---|---|---|
| Gamble | Loss Averse (LA) | | | Gain Seeking (GS) | | | Loss Aversion |
| Pair | x | y | z | a | b | c | Coefficient |
| 1 | $100 | $0 | −$100 | $ 200 | $0 | −$300 | 0.5 |
| 2 | $100 | $0 | −$100 | $ 300 | $0 | −$300 | 1.0 |
| 3 | $100 | $0 | −$100 | $ 350 | $0 | −$300 | 1.25 |
| 4 | $100 | $0 | −$100 | $ 400 | $0 | −$300 | 1.5 |
| 5 | $100 | $0 | −$100 | $ 500 | $0 | −$300 | 2.0 |
| 6 | $100 | $0 | −$100 | $ 600 | $0 | −$300 | 2.5 |
| 7 | $100 | $0 | −$100 | $ 700 | $0 | −$300 | 3.00 |
| 8 | $100 | $0 | −$100 | $ 900 | $0 | −$300 | 4.00 |
| 9 | $100 | $0 | −$100 | $1100 | $0 | −$300 | 5.00 |
| 10 | $100 | $0 | −$100 | $2100 | $0 | −$300 | 10.00 |

In this circumstance, since no transition occurs between loss averse and gain seeking selections, the LALB and LAUB are each taken to be the loss aversion coefficient corresponding to gamble pair 10. Thus, the LAS is 10. The loss aversion component 112 may transmit the LAS to the user computing device 104 stating, "You experience losses more than 10 times stronger than gains."

Example 5—Inconsistent Responses LAS≤10

In Example 5, it is assumed that the user responds in an inconsistent manner, where transitions are observed between more than 1 set of gamble pairs. User selections under these conditions are reflected in Table 6. In Table 6, it may be observed that the user selected the loss averse gamble in gamble pairs 1-3, 7 and 9 and selected the gain seeking gamble in gamble pairs 4-6, 8, and 10.

TABLE 6

| User Responses for Example 5 | | | | | | | |
|---|---|---|---|---|---|---|---|
| Gamble | Loss Averse (LA) | | | Gain Seeking (GS) | | | Loss Aversion |
| Pair | x | y | z | a | b | c | Coefficient |
| 1 | $100 | $0 | −$100 | $ 200 | $0 | −$300 | 0.5 |
| 2 | $100 | $0 | −$100 | $ 300 | $0 | −$300 | 1.0 |
| 3 | $100 | $0 | −$100 | $ 350 | $0 | −$300 | 1.25 |
| 4 | $100 | $0 | −$100 | $ 400 | $0 | −$300 | 1.5 |
| 5 | $100 | $0 | −$100 | $ 500 | $0 | −$300 | 2.0 |
| 6 | $100 | $0 | −$100 | $ 600 | $0 | −$300 | 2.5 |
| 7 | $100 | $0 | −$100 | $ 700 | $0 | −$300 | 3.00 |
| 8 | $100 | $0 | −$100 | $ 900 | $0 | −$300 | 4.00 |
| 9 | $100 | $0 | −$100 | $1100 | $0 | −$300 | 5.00 |
| 10 | $100 | $0 | −$100 | $2100 | $0 | −$300 | 10.00 |

To determine the LALB, the user's selections are examined in ascending order, from gamble pair 1 to 10, until the first transition between loss averse and gain seeking selections is identified. The LALB is taken to be the loss aversion coefficient corresponding to the gamble pair ascendingly examined immediately prior to the transition. In this circumstance, the first transition is identified between gamble pairs 3 and 4. Thus, the LALB is taken to be 1.25, the loss aversion coefficient corresponding to gamble pair 3.

To determine the LAUB, the user's selections are examined in descending order, from gamble pair 10 to 1, until the second transition between loss averse and gain seeking selections is identified. The LAUB is taken to be the loss aversion coefficient corresponding to the gamble pair descendingly examined immediately prior to the second transition. In this circumstance, the first transition occurs between gamble pairs 9 and 10. Thus, the LAUB is taken to be 10.00, the loss aversion coefficient corresponding to gamble pair 10.

The user's loss aversion score is calculated by the loss aversion component 112 as an average of the LALB and LAUB. In this circumstance, the user's loss aversion score is 5.63, the average of 1.25 and 10.00. As the calculated loss aversion score (LAS) lies within the range between 1≤LAS≤10, the the loss aversion component 112 may transmit the LAS to the user computing device 104 stating, "You experience losses 5.63 times stronger than gains. The above is our best estimate of your sensitivity to losses, but be aware that your responses exhibited some inconsistencies. Feel free to retake the test."

Example 6—Inconsistent Responses LAS>10

In Example 6, it is assumed that the user responds in an inconsistent manner. User selections under these conditions are reflected in Table 7. In Table 7, it may be observed that the user selected the loss averse gamble in gamble pairs 1-5, 7 and 10 and selected the gain seeking gamble in gamble pairs 6 and 8-9.

TABLE 7

| User Responses for Example 6 | | | | | | | |
|---|---|---|---|---|---|---|---|
| Gamble | Loss Averse (LA) | | | Gain Seeking (GS) | | | Loss Aversion |
| Pair | x | y | z | a | b | c | Coefficient |
| 1 | $100 | $0 | −$100 | $200 | $0 | −$300 | 0.5 |
| 2 | $100 | $0 | −$100 | $300 | $0 | −$300 | 1.0 |
| 3 | $100 | $0 | −$100 | $350 | $0 | −$300 | 1.25 |
| 4 | $100 | $0 | −$100 | $400 | $0 | −$300 | 1.5 |

TABLE 7-continued

| User Responses for Example 6 | | | | | | | |
|---|---|---|---|---|---|---|---|
| Gamble | Loss Averse (LA) | | | Gain Seeking (GS) | | | Loss Aversion |
| Pair | x | y | z | a | b | c | Coefficient |
| 5 | $100 | $0 | −$100 | $ 500 | $0 | −$300 | 2.0 |
| 6 | $100 | $0 | −$100 | $ 600 | $0 | −$300 | 2.5 |
| 7 | $100 | $0 | −$100 | $ 700 | $0 | −$300 | 3.00 |
| 8 | $100 | $0 | −$100 | $ 900 | $0 | −$300 | 4.00 |
| 9 | $100 | $0 | −$100 | $1100 | $0 | −$300 | 5.00 |
| 10 | $100 | $0 | −$100 | $2100 | $0 | −$300 | 10.00 |

To determine the LALB, the user's selections are examined in ascending order, from gamble pair 1 to 10, until the first transition between loss averse and gain seeking selections is identified. The LALB is taken to be the loss aversion coefficient corresponding to the gamble pair ascendingly examined immediately prior to the first transition. In this circumstance, the first transition is identified between gamble pairs 5 and 6. Thus, the LALB is taken to be 2.0, the loss aversion coefficient corresponding to gamble pair 5.

To determine the LAUB, the user's selections are examined in descending order, from gamble pair 10 to 1, until the second transition between loss averse and gain seeking selections is identified. The LAUB is taken to be the loss aversion coefficient corresponding to the gamble pair descendingly examined immediately prior to the second transition. In this circumstance, the second transition occurs between gamble pairs 9 and 10. Thus, the LAUB is taken to be 10.00, the loss aversion coefficient corresponding to gamble pair 10.

The user's loss aversion score is calculated by the loss aversion component 112 as an average of the LALB and LAUB. In this circumstance, the user's loss aversion score is 6, the average of 2.0 and 10.00. As the calculated loss aversion score (LAS) lies within the range between 1≤LAS≤10, the the loss aversion component 112 may transmit the LAS to the user computing device 104 stating, "You experience losses 6 times stronger than gains. The above is our best estimate of your sensitivity to losses, but be aware that your responses exhibited some inconsistencies. Feel free to retake the test."

Investment Allocation Component

The investment allocation component 114 of the investment personalization system 102 calculates expected utility for a plurality of portfolios using the loss aversion score determined by the loss aversion component 112. As discussed in greater detail below in FIGS. 4A-4C, the investment allocation component 114 further identifies a portfolio having the highest expected utility for the user, based upon their loss aversion score. The identified portfolio may be recommended to the user for consideration.

Figure 4A:
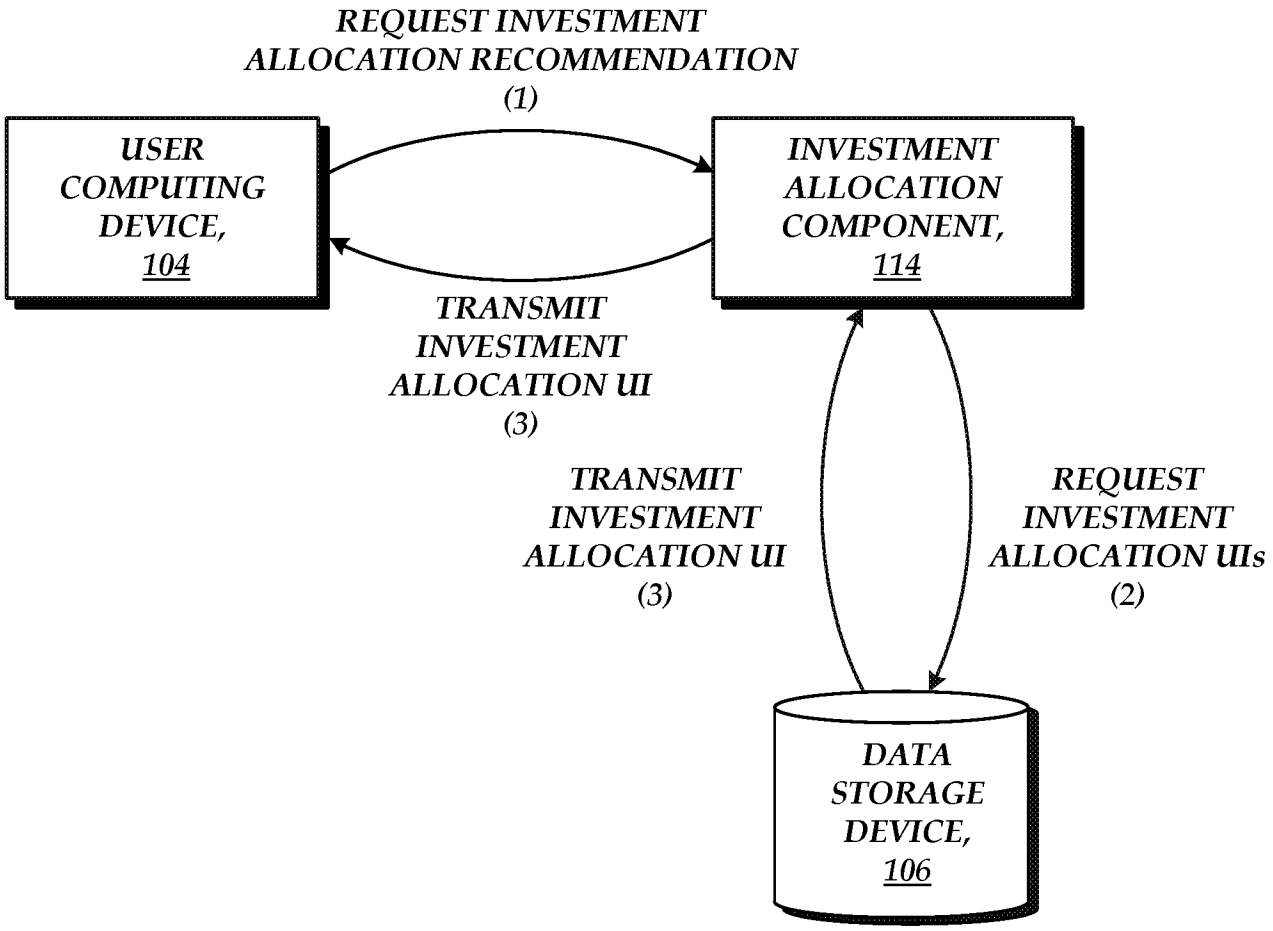
FIGS. 4A-4C are block diagrams illustrating information flow between the investment personalization system and a user computing device for generating a distribution of funds personalized to the user based upon the calculated loss aversion score.

With reference to FIG. 4A, the investment allocation component 114 receives a request from the user computing device 104 for an investment allocation recommendation. In response to this request, the investment allocation component 114 obtains investment allocation interfaces (e.g., from data storage device 106) and transmits the investment allocation interfaces to the user computing device 104 for display.

Figure 4B:
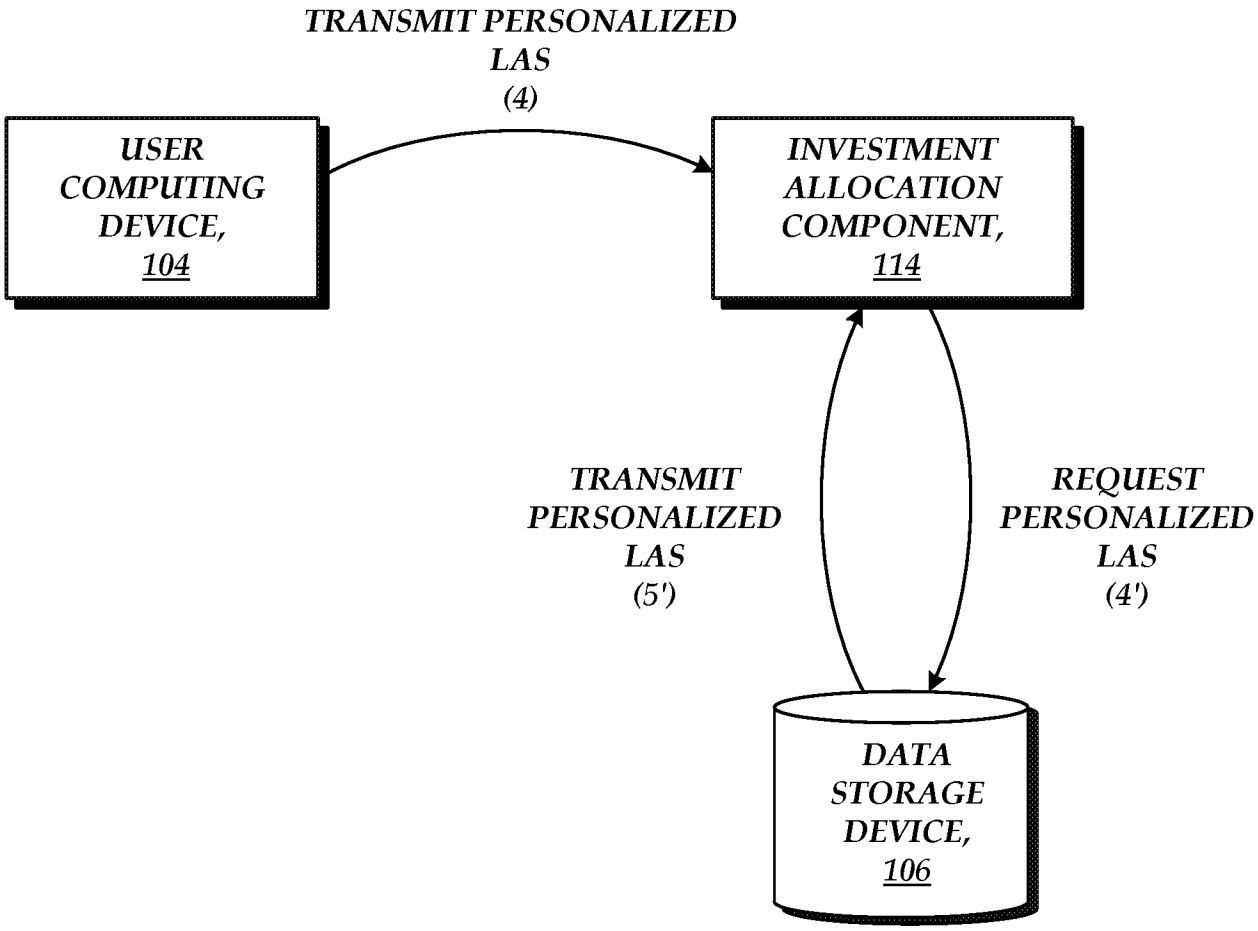

As illustrated in FIG. 4B, the investment allocation component 114 receives the LAS for the user. In an embodiment, LAS may be received from the user via one of the provided user interfaces. In an alternative embodiment, the LAS may be retrieved (e.g., from the data storage device 106).

Figure 4C:
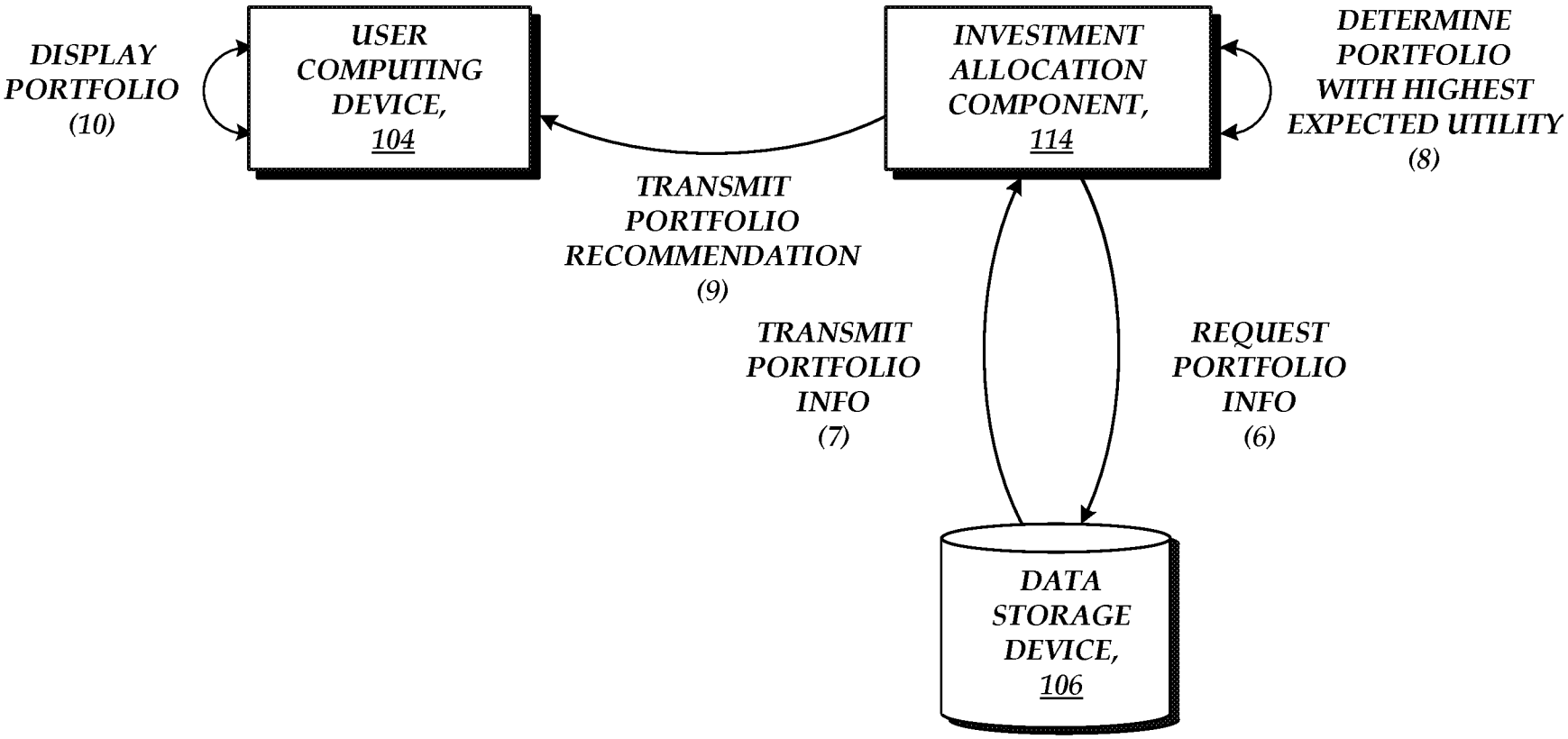

As further illustrated in FIG. 4C, the investment allocation component 114 further provides a personalized portfolio recommendation to the user. The investment allocation component 114 receives a plurality of investment portfolios (e.g., from the data storage device 106). For the sake of example, it will be assumed that at least two portfolios are received by the investment allocation component 114. However, it may be understood that information regarding any number of portfolios may be received. The portfolios may differ from one another by at least one of a choice of respective holdings contained within the portfolio (e.g., equities, securities, funds, securities, etc.), respective ratios of each holding contained within the portfolio, and the like. Each portfolio is associated with portfolio information including a plurality of possible portfolio outcomes, $\pi_i$, a probability corresponding to each outcome, $p_i$, and a utility corresponding to each outcome, $u(\pi_i)$.

For each portfolio, the investment allocation component 114 calculates an expected utility (EU) based upon its respective portfolio information and the received LAS:

$$EU = \sum_{i=1}^{n} p_i * u(\pi_i)$$

The investment allocation component 114 determines the portfolio having the highest expected utility and provides this portfolio to the user as the portfolio recommendation.

Example 7—Portfolio Recommendation

Loss aversion can be modeled as a bi-linear utility function, where:

$$\pi_i \geq \$0, u(\pi_i) = \pi_i$$

$$\pi_i \leq \$0, u(\pi_i) = \pi_i * \text{LAS}$$

Supposed for the sake of example that there are two portfolios with two outcomes over a one year period:

For portfolio 1, with $100 this portfolio either results in wealth of $200 (a $100 gain) or $50 (a $50 loss) with equal likelihood.

For portfolio 2, with $100 this portfolio either results in wealth of $300 (a $200 gain) or $0 (a $100 loss) with equal likelihood.

Assuming that, that the user's LAS is 3.0, the investment allocation component 114 calculates the expected utility values for portfolio 1 and portfolio 2 to be:

EU for portfolio 1=(½)*($100)+(½)*(3.0)*(−$50)=−$25

EU for portfolio 2=(½)*($200)+(½)*(3.0)*(−$100)=−$50

As portfolio 1 has the highest expected utility, the investment allocation component 114 provides portfolio 1 to the user as the portfolio recommendation.

It may be understood that the LAS may vary between users or be time-variant for a given user. Furthermore, if the LAS is changed, then the recommendation may also change. Continuing the example above, now assume that the user's LAS is 2.0, instead of 3.0. Under this new set of circumstances, the investment allocation component 114 calculates expected utility values for portfolio 1 and 2 to be:

EU for portfolio 1=(½)*($100)+(½)*(2.0)*(−$50)=$0

EU for portfolio 2=(½)*($200)+(½)*(2.0)*(−$100)=$0

As portfolio 1 and portfolio 2 has equal expected utility, the investment allocation component 114 provides portfolios 1 and 2 to the user as the portfolio recommendation.

Continuing the above-discussed example, now assume that the user exhibits an LAS of 1.5. Under these circumstances, the investment allocation component 114 calculates the expected utility values for portfolio 1 and portfolio 2 to be:

EU for portfolio 1=(½)*($100)+(½)*(1.5)*(−$50)=$12.50

EU for portfolio 2=(½)*($200)+(½)*(1.5)*(−$100)=$25

As portfolio 2 has the highest expected utility, the investment allocation component 114 provides portfolio 2 to the user as the portfolio recommendation.

Fund Rating Component

The fund rating component 116 of the investment personalization system 102 calculates expected utility for a plurality of funds using the loss aversion score determined by the loss aversion component 112. Each fund is a different investment vehicle (e.g., an index fund or stock in a particular company). As discussed in greater detail below in FIGS. 4A-4C, the fund rating component 116 further employs the user's loss aversion score to generate expected utilities for each fund and a distribution of funds customized to the user. The funds may be further rated based upon the customized distribution and the customized distribution recommended to the user for consideration.

Figure 5A:
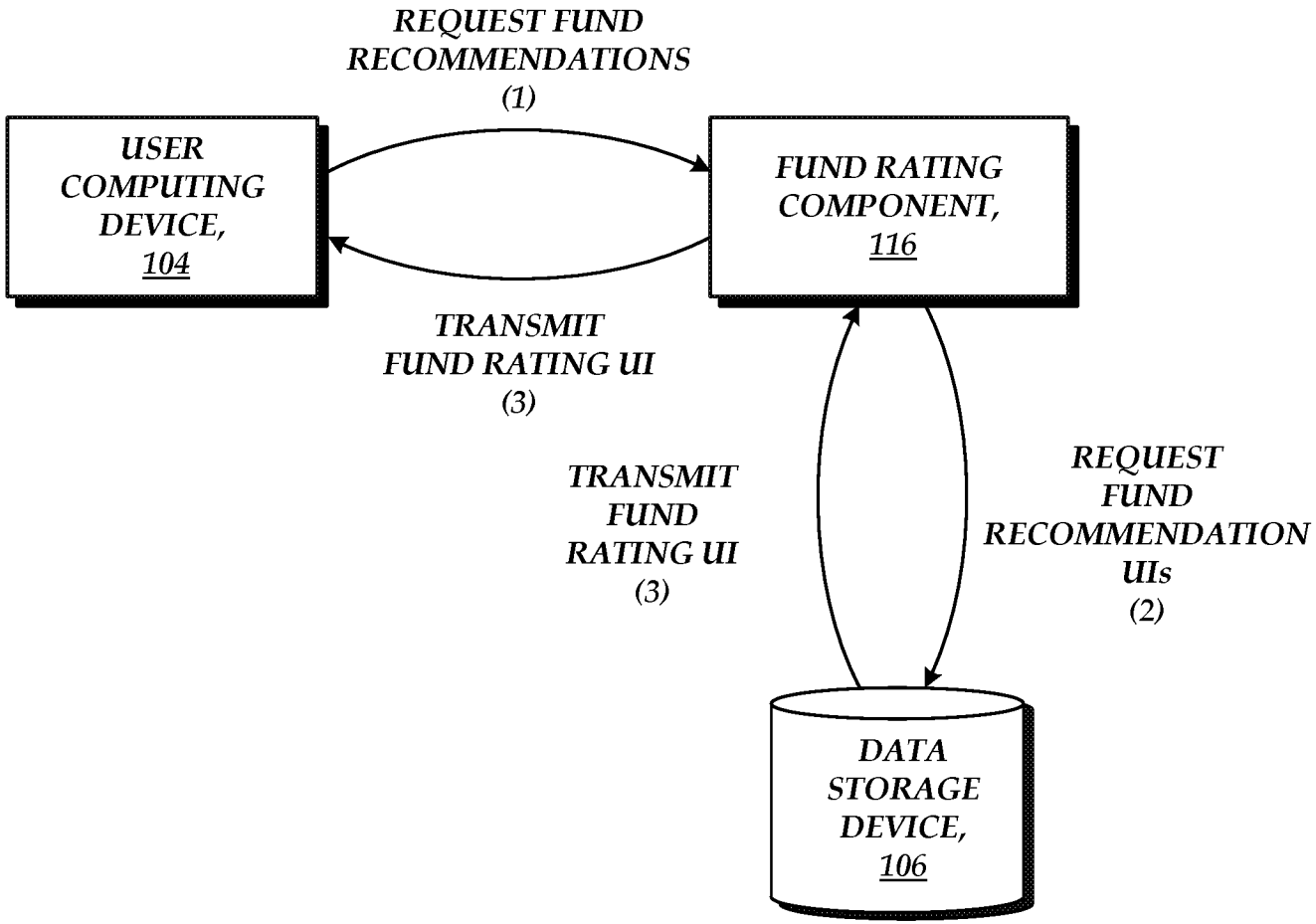
FIGS. 5A-5D are block diagrams illustrating information flow between the investment personalization system and a user computing device for generating a distribution of funds based upon the expected utility of each fund.

With reference to FIG. 5A, the fund rating component 116 receives a request from the user computing device 104 for fund recommendations. In response to this request, the fund rating component 116 obtains fund rating interfaces (e.g., from data storage device 106) and transmits the fund rating interfaces to the user computing device 104 for display to the user.

Figure 5B:
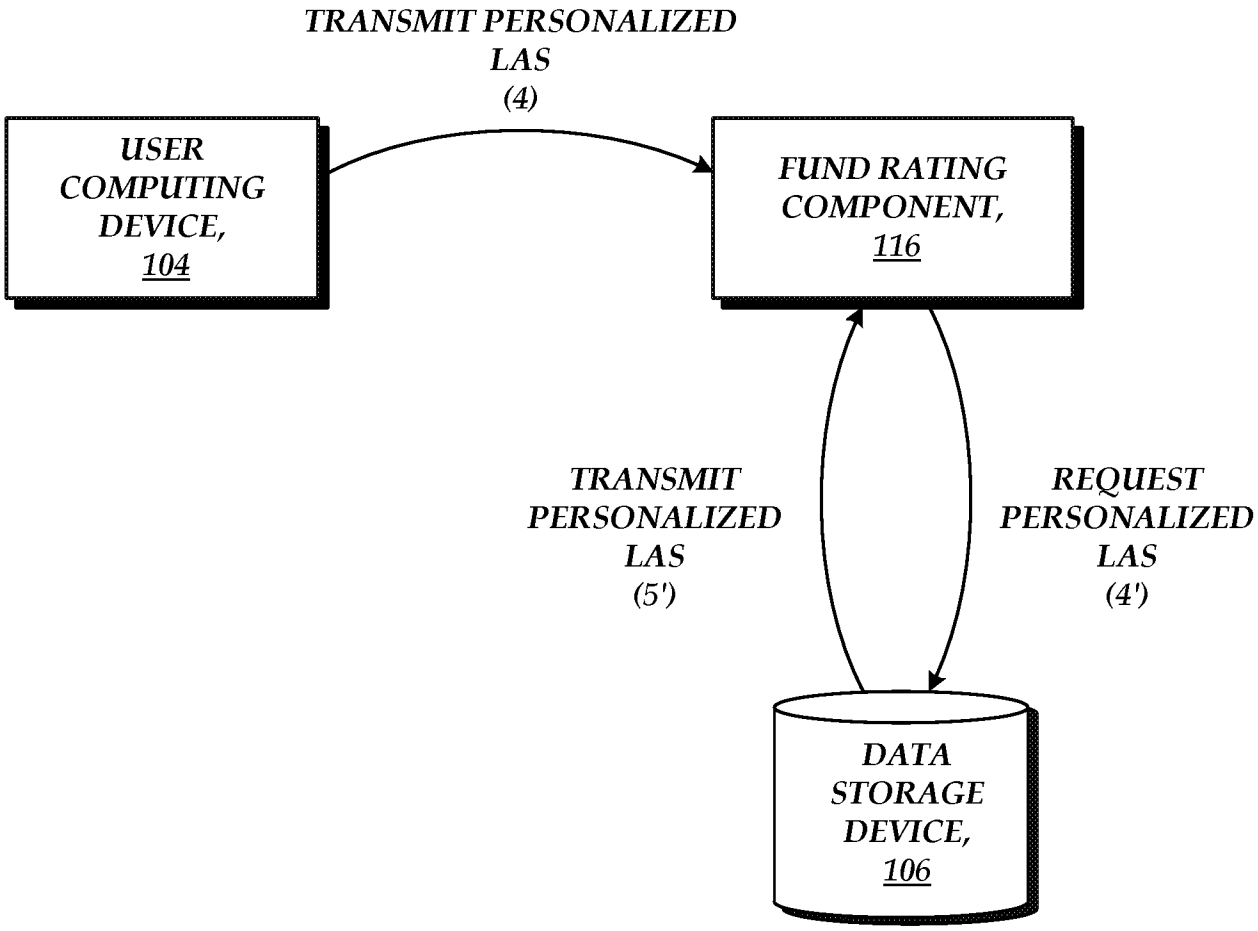

As illustrated in FIG. 5B, the fund rating component 116 receives the LAS for the user. In an embodiment, LAS may be received from the user via one of the provided user interfaces. In an alternative embodiment, the LAS may be retrieved (e.g., upon request from the data storage device 106).

Figure 5C:
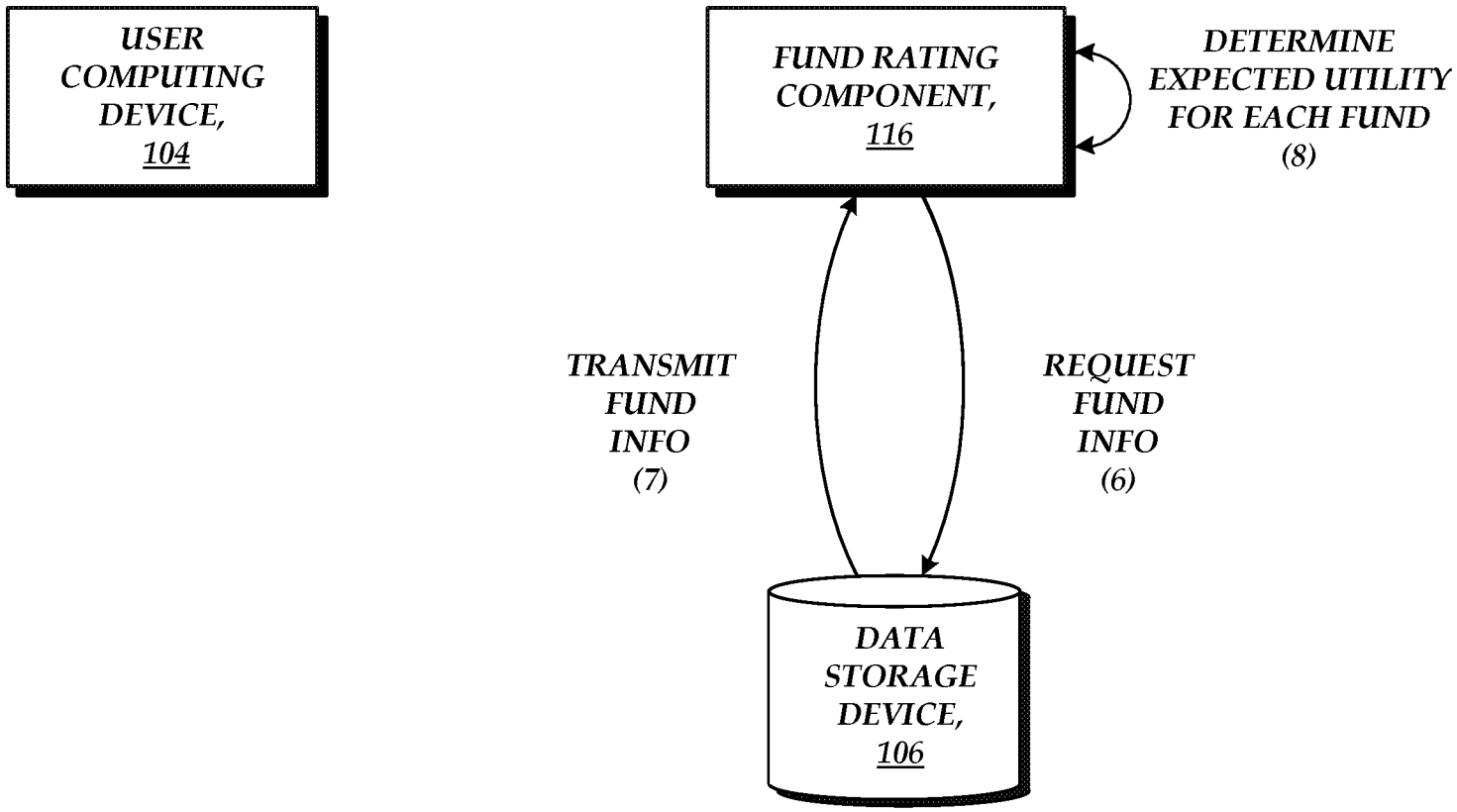
Figure 5D:
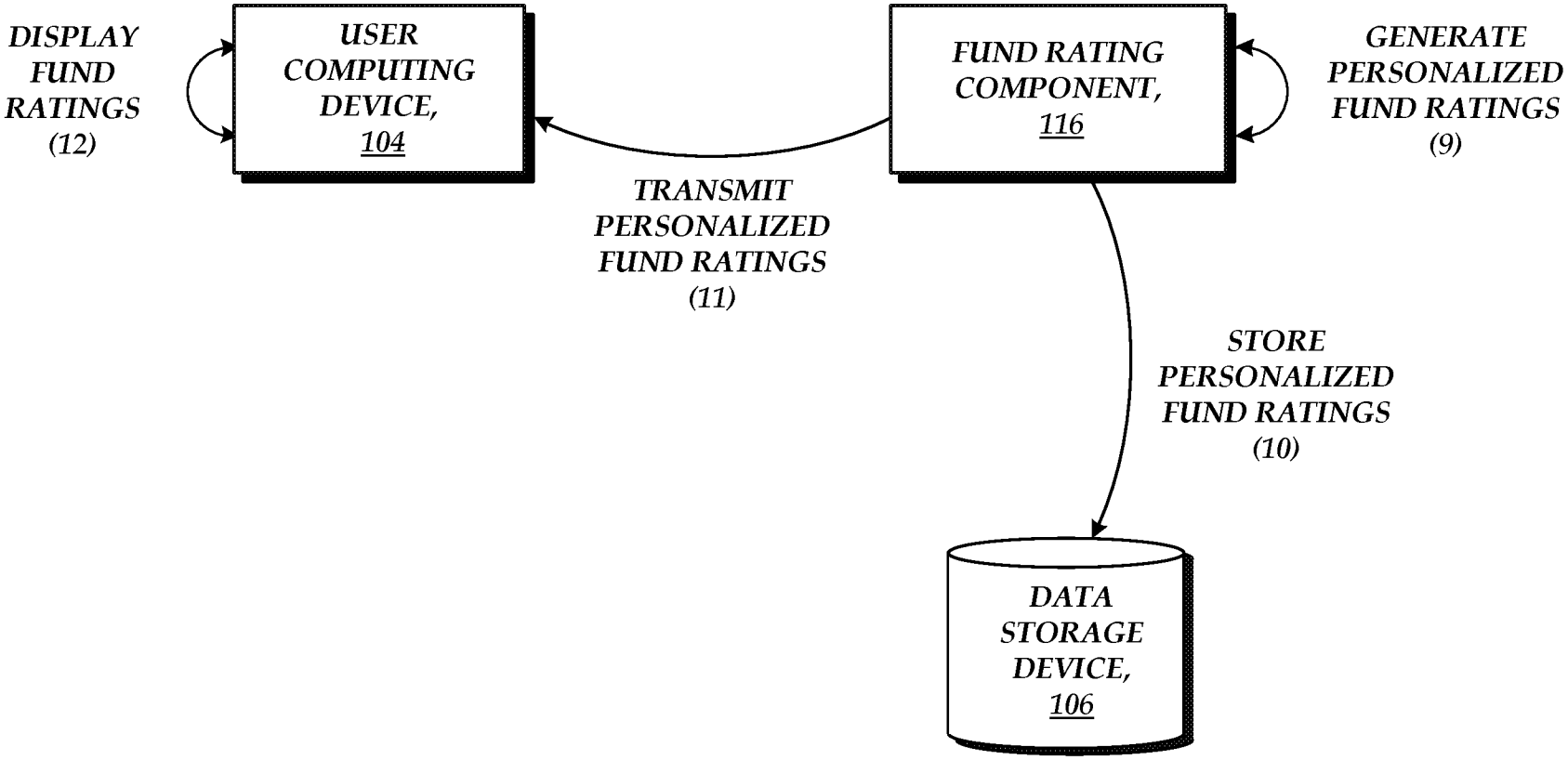

As further illustrated in FIG. 5C, the fund rating component 116 further provides personalized fund recommendations (e.g., fund ratings) to the user. The fund rating component 116 receives a plurality of fund information (e.g., from the data storage device 106). For the sake of example, it will be assumed that information regarding at least two funds is received by the fund rating component 116. However, it may be understood that information regarding any number of funds may be received. The fund information includes a plurality of possible fund outcomes, $\pi_i$, a probability corresponding to each fund outcome, $p_i$, and a utility corresponding to each fund outcome, $u(\pi_i)$. Based upon the respective fund information and the received LAS, the fund rating component 116 calculates an expected utility (EU) for each fund according to:

$$EU = \sum_{i=1}^{n} p_i * u(\pi_i)$$

From these expected utilities, the fund rating component 116 creates a personalized fund rating for each of the funds. For example, the fund rating component 116 may rank or order funds according to their calculated expected utility (e.g., from highest to lowest). From this ranking, each fund may be bucketed into quintiles having associated ratings from 1 to 5, where a rating of 1 is given to funds in the lowest quintile and a rating of 5 is given to funds within the top quintile. The fund rating component 116 may further transmit these personalized fund ratings to the user computing device 104 for display to the user.

Example 8—Fund Ratings

Loss aversion can be modeled as a bi-linear utility function, where:

$$\pi_i \geq \$0, u(\pi_{ti}) = \pi_i$$

$$\pi_i \leq \$0, u(\pi_i) = \pi_i * \text{LAS}$$

Supposed for the sake of example that there are two funds with ten annual outcomes over a ten year period:

For fund 1, with \$100 this fund either results in annual wealth of \$200 (a \$100 gain) for five years or \$50 (a \$50 loss) for the other five years.

For fund 2, with \$100 this fund either results in wealth of \$300 (a \$200 gain) for five years or \$0 (a \$100 loss) for the other five years.

Assuming that the user's LAS is 3.0, the fund rating component 116 calculates the expected utility values for fund 1 and fund 2 to be:

EU for fund 1=5*(1/10)*(\$100)+5*(1/10)*(3.0)*(−\$50)=−\$25

EU for fund 2=5*(1/10)*(\$200)+5*(1/10)*(3.0)*(−\$100)=−\$50

Thus, the fund rating component 116 ranks fund 1 higher than fund 2 for the individual.

It may be understood that the LAS may vary between users or be time-variant for a given user. Furthermore, if the LAS is changed, then the recommendation may also change. Continuing the example above, now assume that the user's LAS is 2.0, instead of 3.0. Under this new set of circumstances, the fund rating component 116 calculates the expected utility values for fund 1 and fund 2 to be:

EU for fund 1=5*(1/10)*(\$100)+5*(1/10)*(2.0)*(−\$50)=\$0

EU for fund 2=5*(1/10)*(\$200)+5*(1/10)*(2.0)*(−\$100)=\$0

As fund 1 and fund 2 have equal expected utility, the fund rating component 116 ranks funds 1 and 2 as equal.

Continuing the above-discussed example, now assume that the user exhibits an LAS of 1.5. Under these circumstances, the fund rating component 116 calculates the expected utility values for fund 1 and fund 2 to be:

EU for fund 1=5*(½)*(\$100)+5*(½)*(1.5)*(−\$50)=\$12.50

EU for fund 2=5*(½)*(\$200)+5*(½)*(1.5)*(−\$100)=\$25

As fund 2 has the highest expected utility, the fund rating component 116 ranks fund 2 higher than fund 1.

It will be appreciated by one of skill in the art that all of the functions, systems and methods discussed herein can be implemented in digital electronic circuitry, in computer hardware, firmware, software, and combinations thereof. The implementation can be as a computer program product. The implementation can, for example, be in a machine-readable storage device, for execution by, or to control the operation of, data processing apparatus. The implementation can, for example, be a programmable processor, a computer, and/or multiple computers.

A computer program can be written in any form of programming language, including compiled and/or interpreted languages, and the computer program can be deployed in any form, including as a stand-alone program or as a subroutine, element, and/or other unit suitable for use in a computing environment. A computer program can be deployed to be executed on one computer or on multiple computers at one site.

Method operations can be performed by one or more programmable processors executing a computer program to perform functions of the disclosure by operating on input data and generating output. Method operations can also be performed by and an apparatus can be implemented as special purpose logic circuitry. The circuitry can, for example, be a FPGA (field programmable gate array) and/or an ASIC (application-specific integrated circuit). Subroutines and software agents can refer to portions of the computer program, the processor, the special circuitry, software, and/or hardware that implement that functionality.

Processors suitable for the execution of a computer program include, by way of example, both general and special purpose microprocessors, and any one or more processors of any kind of digital computer. Generally, a processor receives instructions and data from a read-only memory or a random access memory or both. The essential elements of a computer are a processor for executing instructions and one or more memory devices for storing instructions and data. Generally, a computer can include, can be operatively coupled to receive data from and/or transfer data to one or more mass storage devices for storing data (e.g., magnetic, magneto-optical disks, or optical disks).

Data transmission and instructions can also occur over a communications network. Information carriers suitable for embodying computer program instructions and data include all forms of non-volatile memory, including by way of example semiconductor memory devices. The information carriers can, for example, be EPROM, EEPROM, flash memory devices, magnetic disks, internal hard disks, removable disks, magneto-optical disks, CD-ROM, and/or DVD-ROM disks. The processor and the memory can be supplemented by, and/or incorporated in special purpose logic circuitry.

To provide for interaction with a user, the above described techniques can be implemented on a computer having a display device. The display device can, for example, be a cathode ray tube (CRT) and/or a liquid crystal display (LCD) monitor. The interaction with a user can, for example, be a display of information to the user and a keyboard and a pointing device (e.g., a mouse or a trackball) by which the user can provide input to the computer (e.g., interact with a user interface element). Other kinds of devices can be used to provide for interaction with a user. Other devices can, for example, be feedback provided to the user in any form of sensory feedback (e.g., visual feedback, auditory feedback, or tactile feedback). Input from the user can, for example, be received in any form, including acoustic, speech, and/or tactile input.

The above described techniques can be implemented in a distributed computing system that includes a back-end component. The back-end component can, for example, be a data server, a middleware component, and/or an application server. The above described techniques can be implemented in a distributing computing system that includes a front-end component. The front-end component can, for example, be a client computer having a graphical user interface, a Web browser through which a user can interact with an example implementation, and/or other graphical user interfaces for a transmitting device.

The system can include clients and servers. A client and a server are generally remote from each other and typically interact through a communication network. The relationship of client and server arises by virtue of computer programs running on the respective computers and having a client-server relationship to each other.

Packet-based networks can include, for example, the Internet, a carrier internet protocol (IP) network (e.g., local area network (LAN), wide area network (WAN), campus area network (CAN), metropolitan area network (MAN), home area network (HAN)), a private IP network, an IP private branch exchange (IPBX), a wireless network (e.g., radio access network (RAN), 802.11 network, 802.16 network, general packet radio service (GPRS) network, HiperLAN), and/or other packet-based networks. Circuit-based networks can include, for example, the public switched telephone network (PSTN), a private branch exchange (PBX), a wireless network (e.g., RAN, bluetooth, code-division multiple access (CDMA) network, time division multiple access (TDMA) network, global system for mobile communications (GSM) network), and/or other circuit-based networks.

The terms comprise, include, and/or plural forms of each are open ended and include the listed parts and can include additional parts that are not listed. The term and/or is open ended and includes one or more of the listed parts and combinations of the listed parts.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A computer-implemented method for quantifying a user's tolerance for risk to allow for generation of personalized financial advice, comprising:

randomly generating, by a processor, a plurality of gamble pairs;

each of the plurality of gamble pairs includes a loss aversion gamble and a gain seeking gamble;

the loss aversion gamble includes, a first amount, a second amount, and a third amount randomly generated by the processor; the first amount being greater than the second amount; the second amount being greater than the third amount;

the gain seeking gamble includes a fourth amount, a fifth amount, and a sixth amount randomly generated by the processor; the fourth amount being greater than the fifth amount; the fifth amount being greater than the sixth amount;

the fourth amount is greater than the first amount; and the sixth amount is less than the third amount;

determining, by the processor, a loss aversion coefficient for each of said plurality of gamble pairs;

randomly determining, by the processor, an order in which to present the plurality of gamble pairs to the user via a user interface;

presenting, via the user interface, in the randomly determined order, the gamble pairs to the user;

receiving, via the user interface, in response to the presentation of each gamble pair, the user's selection of either the loss aversion gamble or the gain seeking gamble;

storing the user's selections in a computer memory;

automatically identifying, using the processor, a pattern in the user's stored selections, including identifying at least one transition between the user's selection of the loss aversion gamble and the user's selection of the gain seeking gamble between gamble pairs having consecutively higher loss aversion coefficients;

using the at least one transition to determine a loss aversion score for the user;

wherein the loss aversion score depends at least in part on the loss aversion coefficient of a gamble pair associated with the at least one transition; and displaying a message, via the user interface, based on the loss aversion score.

2. The computer-implemented method of claim 1, further comprising the step of determining the loss aversion score by identifying, using the processor, a loss aversion upper bound and a loss aversion lower bound associated with a transition.

3. The computer-implemented method of claim 2 further comprising the step of averaging, using the processor, the loss aversion upper bound and the loss aversion lower bound to determine the loss aversion score.

4. The computer-implemented method of claim 3 further comprising:

determining, using the processor, that the at least one transition equals two or more transitions; and the message displayed via the user interface informs the user that the user's selections include an inconsistency.

5. The computer-implemented method of claim 1 wherein each of said first amount, second amount, and third amount have an equal probability of occurrence.

6. The computer implemented method of claim 1 wherein the loss aversion coefficient for each gamble pair is determined using the formula:

$$(\text{fourth amount}-\text{first amount})|(\text{third amount}-\text{sixth amount})|.$$

7. A personalized loss aversion determination system, comprising:

a plurality of first data storage devices maintaining a gamble table, the gamble table including N gamble pairs, where N is greater than or equal to two, each gamble pair including a loss aversion gamble, a gain seeking gamble, and a corresponding loss aversion coefficient;

a loss aversion computing device in communication with the first plurality of data storage devices, the loss aversion computing device operative to, for each gamble pair from i=1 to N:

transmit to a user interface, in response to a user request via the user interface, in an order randomly selected by the loss aversion computing device, the loss aversion gamble and gain seeking gamble for each gamble pair;

wherein for each gamble pair from i=1 to N, the gain seeking gamble comprises a first outcome, $a_i$, having a first probability, $p_i$; a second outcome, $b_i$, having a second probability, $q_i$; and a third outcome, $c_i$, having a third probability, $1-p_i-q_i$; wherein $a_i>b_i>c_i$; and wherein for each gamble pair i=1 to N, the loss averse gamble comprises a fourth outcome, $x_i$, having a fourth probability, $r_i$; a fifth outcome, $y_i$, having a fifth probability, $s_i$; and a sixth outcome, $z_i$, having a sixth probability, $1-r_i-s_i$; wherein $x_i>y_i>z_i$; and wherein, each of the probabilities is randomly selected by the loss aversion computing device such that $a_i>x_i$, $b=y_i$, and $c_i<z_i$, receive, in response to transmitting each gambling pair for each gamble pair i=1 to N, a user selection via the user interface of either the $i^{th}$ loss aversion gamble or the $i^{th}$ gain seeking gamble;

identify transitions between the received selections from loss aversion selection to a gain seeking selection;

automatically calculating a personalized loss aversion score for the user based upon the loss aversion coefficients corresponding to the identified transitions;

sending a message relating to the loss aversion score to a user interface to be displayed to the user.

8. The loss aversion determination system of claim 7, wherein the loss aversion computing device is further operative to identify the transitions by:

examining the selections in ascending order of loss coefficient until a first transition between loss averse and gain seeking selections is detected;

determining a loss aversion lower bound (LALB) as the loss aversion coefficient corresponding to the gamble pair ascendingly examined immediately prior to the first transition;

examining the selections in descending order of loss coefficient until a second transition between loss averse and gain seeking selections is detected; and determining a loss aversion upper bound (LAUB) as the loss coefficient corresponding to the gamble pair descendingly examined immediately prior to the second transition.

9. The loss aversion determination system of claim 8, wherein the loss aversion computing device is further operative to calculate the personalized loss aversion score as the average of the LALB and the LAUB.

10. The loss aversion determination system of claim 8 wherein the first probability, second probability, and the third probability are equal.

11. The loss aversion determination system of claim 8 wherein at least one of the first probability and the second probability is different from the third probability.

12. A non-transitory computer readable medium with computer executable instructions stored thereon executed by a digital processor to perform the method of determining a loss aversion score for a user, comprising:

instructions for automatically generating a gamble table comprising a plurality of randomly generated gamble pairs; each of said plurality of gamble pairs including a loss aversion gamble and a gain seeking gamble;

wherein the loss aversion gamble includes a first amount, a second amount, and a third amount; the first amount being greater than the second amount; the second amount being greater than the third amount; and, wherein the gain seeking gamble includes a fourth amount, a fifth amount, and a sixth amount; the fourth amount being greater than the fifth amount; the fifth amount being greater than the sixth amount;

the fourth amount is greater than the first amount; and the sixth amount is less than the third amount;

instructions for automatically determining a loss aversion coefficient for each of said plurality of gamble pairs;

instructions for displaying each of said plurality of gamble pairs, via a user interface, in a random order;

instructions for receiving from a user interface, for each of said plurality of gamble pairs, a user selection; each user selection including one of the loss aversion gamble and the gain seeking gamble;

instructions for identifying at least one transition among the user selections based on the loss aversion coefficients;

instructions for determining the loss aversion score based on the loss aversion coefficient associated with said at least one transition; and instructions for displaying a message, via a user interface, based on said loss aversion score.

13. The non-transitory computer readable medium of claim 12 further comprising instructions for generating the gamble table such that no gain seeking gamble in one gamble pair is the same as a gain seeking gamble in another gamble pair.

14. The non-transitory computer readable medium of claim 12 further comprising instructions for using said at least one transition to determine at least one of a loss aversion upper bound and a loss aversion lower bound.

15. The non-transitory computer readable medium of claim 14 further comprising instructions for averaging the loss aversion upper bound and the loss aversion lower bound to determine the loss aversion score.

16. The non-transitory computer readable medium of claim 15 further comprising instructions for determining that said at least one transition equals a plurality of transitions.

17. The non-transitory computer readable medium of claim 16 further comprising instructions for determining that the plurality of transitions indicate an inconsistency in the user selections.

18. The non-transitory computer readable medium of claim 17 wherein the computer executable instructions are accessible, at least in part, over a mobile computer.

* * * * *